US010487508B2

(12) United States Patent
Grubka et al.

(10) Patent No.: US 10,487,508 B2
(45) Date of Patent: Nov. 26, 2019

(54) PREFABRICATED OFFSET SHINGLE

(71) Applicant: Owens Corning Intellectual Capital, LLC, Toledo, OH (US)

(72) Inventors: Lawrence Jerome Grubka, Westerville, OH (US); Christina Marie Wise, Granville, OH (US); William Edwin Smith, Pataskala, OH (US); Bert W. Elliott, Toledo, OH (US); Mark Burger, Newport Beach, CA (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 15/790,136

(22) Filed: Oct. 23, 2017

(65) Prior Publication Data

US 2018/0112406 A1 Apr. 26, 2018

Related U.S. Application Data

(60) Provisional application No. 62/411,122, filed on Oct. 21, 2016, provisional application No. 62/433,684, filed on Dec. 13, 2016.

(51) Int. Cl.
*E04D 1/26* (2006.01)
*E04D 1/36* (2006.01)

(52) U.S. Cl.
CPC *E04D 1/26* (2013.01); *E04D 1/36* (2013.01)

(58) Field of Classification Search
CPC ..... E04D 1/26; E04D 1/36
USPC ..... 52/98, 519, 535, 553, 573.1, 314
See application file for complete search history.

(56) References Cited

U.S. PATENT DOCUMENTS

| | | | | |
|---|---|---|---|---|
| 1,495,070 | A * | 5/1924 | Finley | E04D 1/26 52/555 |
| 2,756,699 | A * | 7/1956 | Lockwood | E04D 1/16 52/546 |
| 2,885,073 | A | 5/1959 | Bettoli et al. | |
| 2,952,107 | A | 9/1960 | Fuller | |
| 3,138,251 | A | 6/1964 | Olszyk et al. | |
| 3,312,031 | A * | 4/1967 | Berg | E04D 3/30 52/316 |
| 4,279,106 | A * | 7/1981 | Gleason | E04D 1/265 52/100 |

(Continued)

OTHER PUBLICATIONS

Owens Corning brochure, Classic Super, Shingles Installation Instructions, 8 pgs., Aug. 2015.

(Continued)

*Primary Examiner* — Brent W Herring
(74) *Attorney, Agent, or Firm* — Calfee, Halter & Griswold LLP

(57) ABSTRACT

An exemplary prefabricated offset shingle includes a headlap portion extending from a top edge to a nail zone, a tab portion extending from the nail zone to a bottom edge, the headlap portion and the tab portion extending between first and second side edges. Two transverse cuts extend from the bottom edge to the headlap portion, and frangible lines of weakness in line with the transverse cuts extend from the transverse cuts to the top edge. The cuts and lines of weakness separate the shingle into first, second, and third offset portions having first, second, and third widths.

8 Claims, 20 Drawing Sheets

(56) References Cited

U.S. PATENT DOCUMENTS 4,468,903 A * 9/1984 Eaton ..... E04D 1/265 52/105
4,527,374 A * 7/1985 Corbin ..... E04D 1/26 52/557
4,637,191 A * 1/1987 Smith ..... E04D 1/26 52/522
5,455,099 A * 10/1995 Banner ..... E04F 13/0864 428/122
5,611,186 A * 3/1997 Weaver ..... E04D 1/26 52/314
5,615,523 A * 4/1997 Wells ..... E04D 1/20 52/309.1
6,014,847 A * 1/2000 Phillips ..... E04D 1/26 52/311.1
6,021,611 A * 2/2000 Wells ..... E04D 1/08 52/309.1
6,083,594 A * 7/2000 Weinstein ..... B32B 5/26 428/167
6,112,492 A * 9/2000 Wells ..... E04D 1/08 52/309.1
6,199,338 B1 * 3/2001 Hudson, Jr. ..... E04D 1/26 52/105
6,383,594 B2 * 5/2002 Weinstein ..... B32B 5/26 428/43
6,484,463 B1 * 11/2002 Fay ..... E04B 1/7662 428/138
6,743,326 B2 * 6/2004 Bogrett ..... E04B 1/767 156/268
6,935,080 B2 * 8/2005 Allwein ..... E04B 1/767 428/136
8,430,983 B2 4/2013 Vermilion et al.
8,647,184 B2 * 2/2014 Kortuem ..... F24F 7/02 454/260
8,763,807 B2 7/2014 Booch et al.
9,017,791 B2 * 4/2015 Grubka ..... E04D 1/20 428/136
9,121,178 B2 9/2015 Belt et al.
9,540,817 B2 * 1/2017 Folkersen ..... E04D 1/26
10,041,253 B2 * 8/2018 Folkersen ..... E04D 1/26
2004/0055227 A1 * 3/2004 Allwein ..... E04B 1/767 52/98
2004/0111996 A1 * 6/2004 Heroneme ..... B32B 7/04 52/518
2005/0235582 A1 * 10/2005 Allwein ..... E04B 1/767 52/98
2008/0280554 A1 * 11/2008 Kortuem ..... F24F 7/02 454/260
2015/0089892 A1 * 4/2015 Jenkins ..... E04D 1/26 52/311.2
2017/0081854 A1 3/2017 Folkersen et al.
2017/0306627 A1 * 10/2017 Grubka ..... E04D 1/20

OTHER PUBLICATIONS

Owens Corning brochure, Oakridge Shingles, Installation Instructions, 7 pgs., Aug. 2017.
ASHI Reporter, Oct. 2010, Article by Tom Feiza "Don't Miss the Shingle Stagger", Inspection News and View from the American Society of Home Inspectors, 8 pgs.
Office Action from U.S. Appl. No. 16/198,077 dated Oct. 3, 2019.

* cited by examiner

PREFABRICATED OFFSET SHINGLE

CROSS-REFERENCE TO RELATED APPLICATIONS

The present application claims the benefit of U.S. Provisional Application Ser. No. 62/411,122, filed on Oct. 21, 2016, titled PREFABRICATED OFFSET SHINGLE and U.S. Provisional Application Ser. No. 62/433,684, filed on Dec. 13, 2016, titled PREFABRICATED OFFSET SHINGLE, the disclosures of which are incorporated herein by reference in their entirety.

TECHNICAL FIELD

The present invention relates generally to roof shingles for protecting a roof of a structure, and more particularly, prefabricated offset shingles for application at the start of courses of shingles.

BACKGROUND OF THE INVENTION

Many structures have pitched, shingled roofs, which prevent water, e.g., rain water, from entering the structures by causing water to pass over the shingles and shed off the roofs. A pitched, shingled roof has a pitched substrate, such as a plurality of plywood sheets, with a plurality of shingles attached thereto.

Each shingle has an upper portion (i.e., a headlap portion) and a lower portion (i.e., an exposure portion) wherein the exposure portion is exposed to the environment. The shingles are typically attached to the substrate in rows known as courses wherein the exposure portion of an upper course of shingles overlaps the headlap portion of an adjacent lower course of shingles. For example, a first course of shingles may be attached to the substrate nearest the lowest point of the roof, i.e., the eave portion of the roof. A second course of shingles may then be attached to the substrate slightly higher on the roof than the first course. The shingles are placed so that the exposure portion of the second course of shingles overlaps the headlap portion of the first course of shingles. This overlapping continues with successive rows of shingles to the highest point on the area of the roof, i.e., the hip or the ridge.

To prevent alignment of the seams between shingles in adjacent courses (and thereby allow for a leak path through the shingles), the first shingle in each course may be cut shorter to create an offset shingle. Offset shingles are applied at the start of a course of shingles, and the width of the offset shingles in each course is varied so the seams between shingles in adjacent courses are not aligned.

Attaching the shingles to the roof is typically achieved by the use of nails or other fastening devices that pass through the shingles and into or through the substrate. The fastening devices are typically placed through the headlap portion of the shingles so that they are overlapped by shingles in an adjacent higher course as described above. This placement of the fasteners prevents water from entering the structure through holes caused by the fasteners.

Some roofs have a membrane (i.e., an underlayment) located between the substrate and the shingles. The membrane may, as an example, be conventional tar paper or other underlayment material that is nailed to the substrate. Strips of the membrane are typically attached to the roof in an overlapping fashion wherein an upper strip overlaps its adjacent lower strip. Accordingly, the membrane serves to shield the substrate from water should a shingle become damaged. For example, if a shingle becomes cracked or otherwise leaks, water will contact the membrane rather than the substrate. Water will then pass along the membrane without contacting the substrate or entering the structure.

SUMMARY

Exemplary embodiments of shingles are disclosed herein.

An exemplary prefabricated offset shingle includes a headlap portion extending from a top edge to a tab portion, the tab portion extending from the headlap portion to a bottom edge, the headlap portion and the tab portion extending between first and second side edges. Two transverse cuts extend from the bottom edge to the headlap portion, and frangible lines of weakness in line with the transverse cuts extend from the transverse cuts to the top edge. The cuts and lines of weakness separate the shingle into first, second, and third offset portions having first, second, and third widths.

Another exemplary prefabricated offset shingle includes a headlap portion extending from a top edge to a tab portion, the tab portion extending from the headlap portion to a bottom edge, the headlap portion and the tab portion extending between first and second side edges. Three transverse cuts extend from the bottom edge to the headlap portion, and frangible lines of weakness in line with the transverse cuts extend from the transverse cuts to the top edge. The cuts and lines of weakness separate the shingle into first, second, third, and fourth offset portions having first, second, third, and fourth widths.

An exemplary package of offset shingles includes a box having an interior width equal to about one-half of a full shingle width and a plurality of offset shingle segments disposed in the box. The shingle segments each have a front face, a rear face, a headlap portion extending from a top edge to a tab portion, the tab portion extending from the headlap portion to a bottom edge, a width, a sealant proximate the bottom edge of the rear face, and a release tape proximate the top edge of the rear face. The maximum shingle segment width is equal to about one-half of the full shingle width. The shingle segments are arranged in two-layer stacks such that the sealant of a first layer aligns with the release tape of a second layer, and the sealant of the second layer aligns with the release tape of the first layer.

BRIEF DESCRIPTION OF THE DRAWINGS

These and other features and advantages of the present invention will become better understood with regard to the following description and accompanying drawings in which.

DETAILED DESCRIPTION

Prior to discussing the various embodiments, a review of the definitions of some exemplary terms used throughout the disclosure is appropriate. Both singular and plural forms of all terms fall within each meaning.

As described herein, when one or more components are described as being connected, joined, affixed, coupled, attached, or otherwise interconnected, such interconnection may be direct as between the components or may be indirect such as through the use of one or more intermediary components. Also as described herein, reference to a "member," "component," or "portion" shall not be limited to a single structural member, component, or element but can include an assembly of components, members, or elements. Also as described herein, the terms "substantially" and "about" are defined as at least close to (and includes) a given value or state (preferably within 10% of, more preferably within 1% of, and most preferably within 0.1% of).

Figure 1:
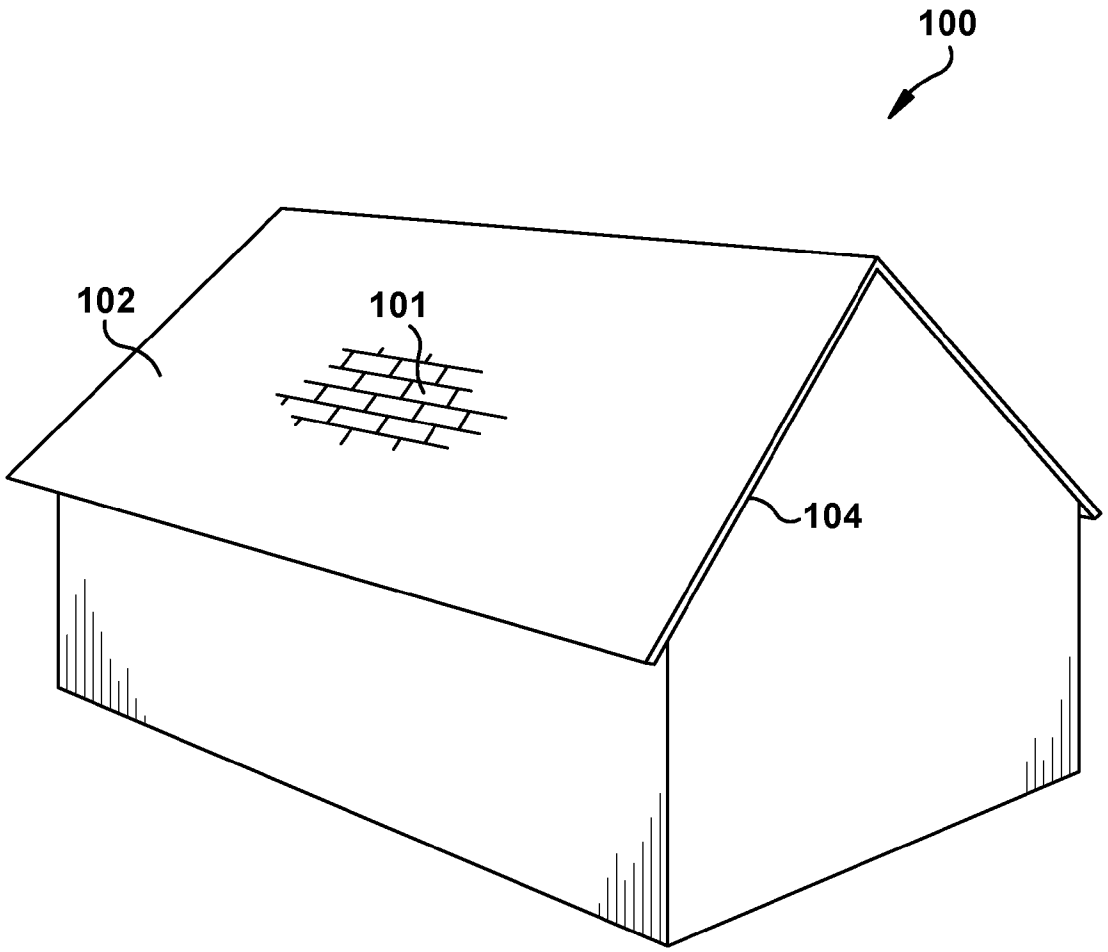
FIG. 1 is a perspective diagram of a roof of a residential home.

Referring now to FIG. 1, a diagram of a roof structure 100 is shown. The roof 100 is a shingled roof, covered with individual shingles 101. The sides 102 of the roof 100 come together to form a ridge at the top of the roof 100 that extends to rake edges 104 and a gable end. The shingles 101 of the roof 100 are applied in courses on top of an optional underlayment (not shown) and sheeting and/or decking (not shown). The shingles 101 may be single-layer three-tab shingles, or may be laminate shingles, such as the shingles described in U.S. Pat. Nos. 8,430,983 and 9,121,178, which are incorporated herein by reference in their entirety.

Figure 2A:
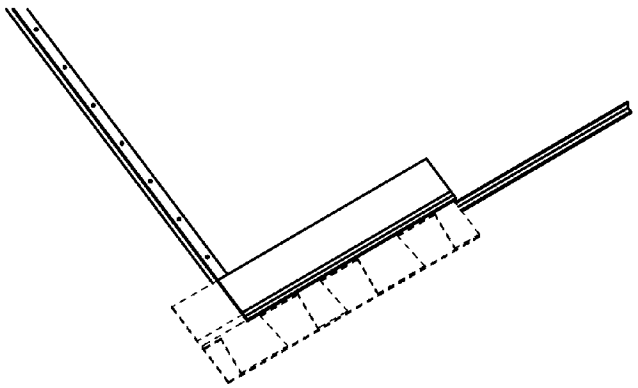
Fig. 2A (Prior Art)
FIGS. 2A-2H illustrate the steps to cut prior art offset shingles.
Figure 2B:
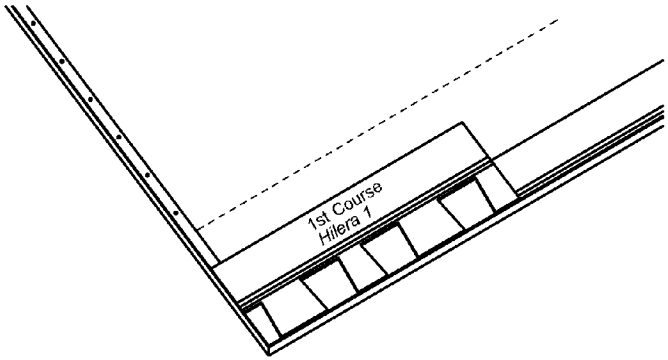
Fig. 2B (Prior Art)
Figure 2C:
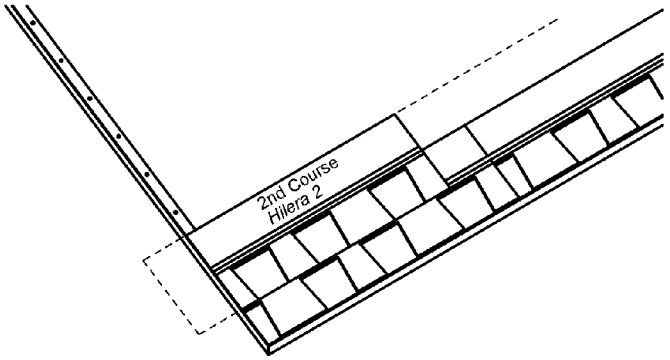
Fig. 2C (Prior Art)
Figure 2D:
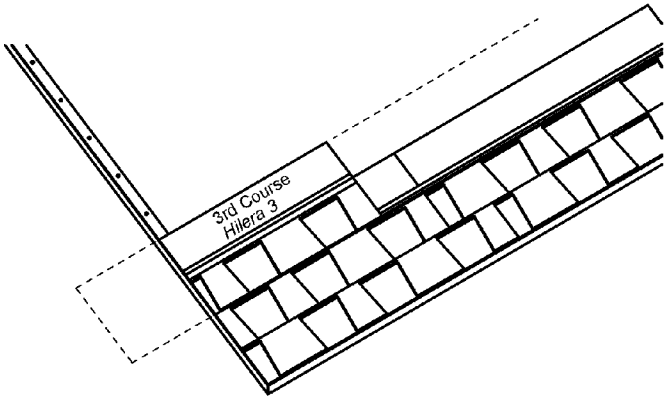
Fig. 2D (Prior Art)
Figure 2F:
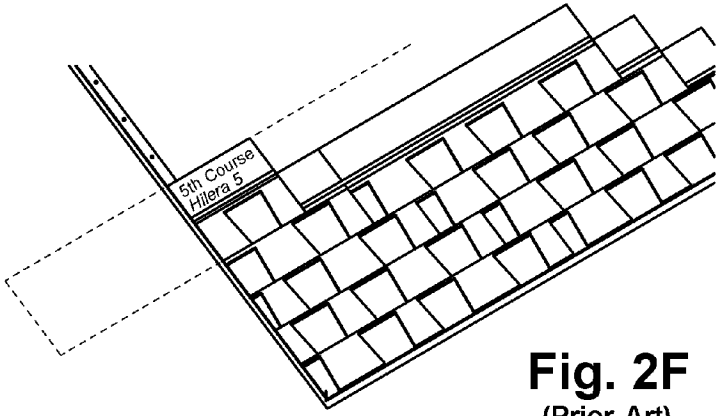
Fig. 2F (Prior Art)
Figure 2H:
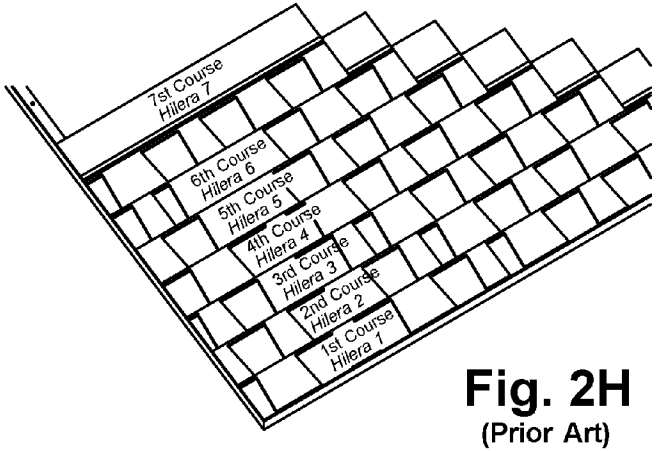
Fig. 2H (Prior Art)
Figure 2E:
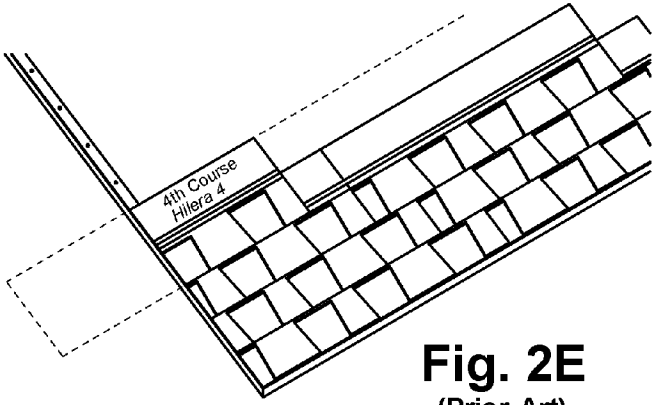
Fig. 2E (Prior Art)
Figure 2G:
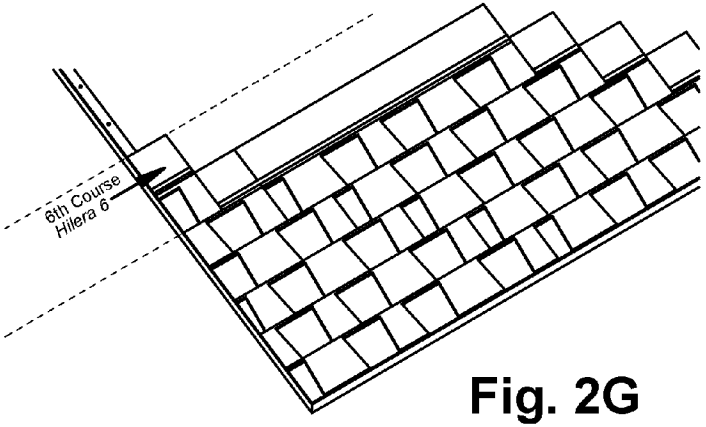
Fig. 2G (Prior Art)

Referring now to FIGS. 2A-2H, steps to apply prior art shingles are shown. A starter course is first applied along the bottom edge of the roof. The starter course is similar to the headlap portion of a shingle or may be the headlap portion of a shingle with the tab portion removed, as shown in FIG. 2A. The first course of shingles is applied on top of the starter course, starting with a full width shingle at the rake edge of the roof as shown in FIG. 2B. To start the second and subsequent courses, a shingle is cut to a reduced width to form an offset shingle to start the course, as shown in FIGS. 2C-2G. Full width shingles are then applied to complete the course (the last shingle in the course being cut to fit the opposing rake edge, valley, hip, etc.). The width of the offset shingle is typically decremented for each course by a set distance, such as, for example, 6.5 inches, 5 inches, or 4 inches, or some other distance that can be divided into the full width of the shingle with little or no remainder. After the smallest offset shingle is used, a full width shingle is typically used to start the next course, as shown in FIG. 2H.

Typically, the measuring and cutting of offset shingles is done manually by the installer of the roof. Straight cuts are difficult to make when up on a rooftop, so many installers will cut the shingles at a cutting station at the ground level to achieve a straight cut. This results in multiple trips up and down a ladder to measure and cut the shingles during installation. In some cases, to avoid trips up and down the ladder, an installer may install full width shingles and let them hang over the rake edge of the roof, cutting the excess shingle material off after a number of courses have been completed. Cutting after installation can damage the edge of the roof, and results in excess material falling to the ground that needs to be cleaned up and is typically wasted. Applicant has appreciated the need for prefabricated offset shingles that can be easily formed out of full width shingles without cutting or measuring to increase the speed and accuracy of installing offset courses of shingles on a rooftop.

Figure 3:
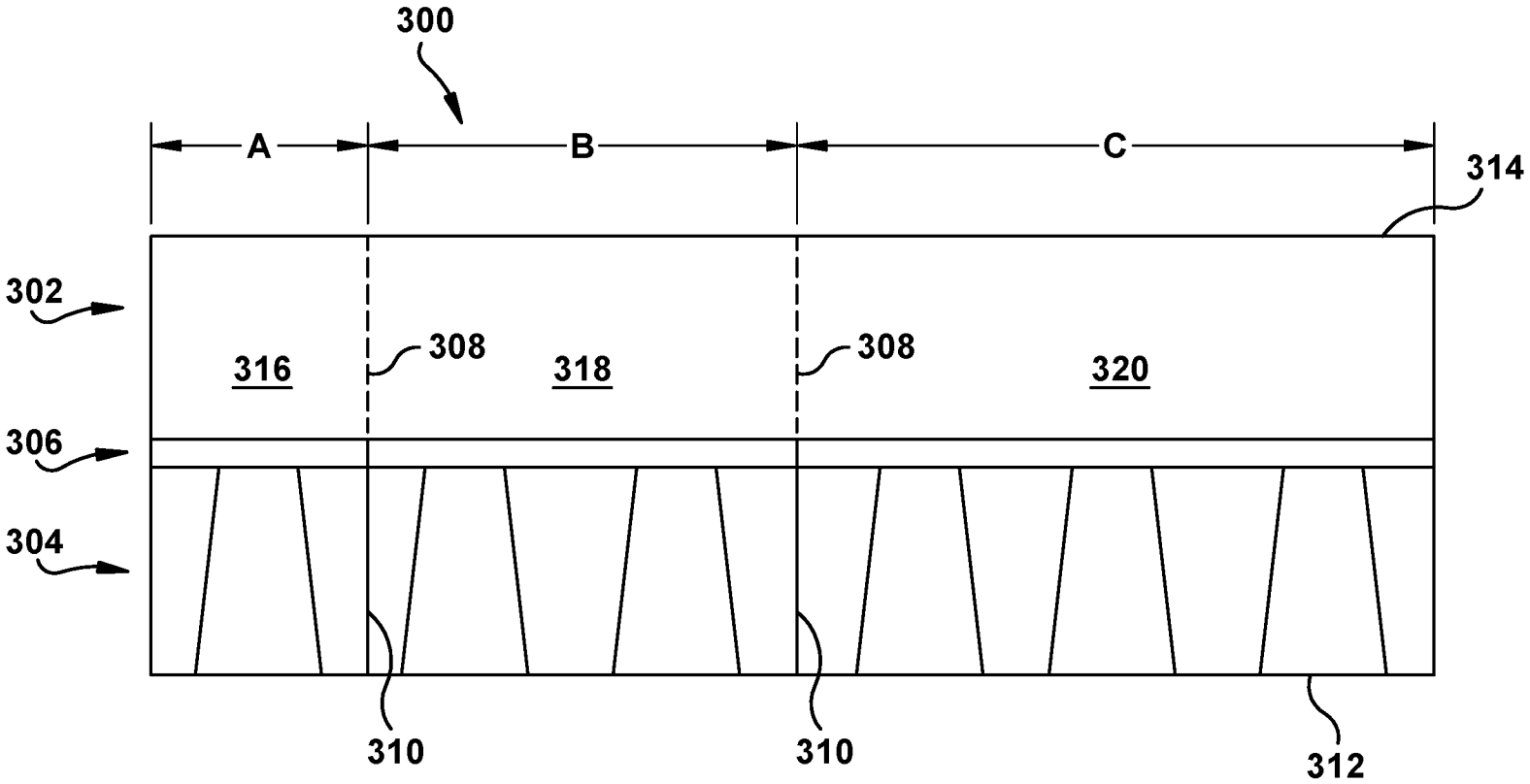
FIG. 3 is a plan view of an exemplary tearable prefabricated offset shingle.

Referring now to FIG. 3, an exemplary prefabricated offset shingle 300 is shown. The shingle 300 extends between first and second side edges and includes a headlap portion 302, a tab portion 304, and a nail zone 306. Transverse cuts 310 extend from a bottom edge 312 through the tab portion 304 and nail zone 306. Frangible lines of weakness 308 in line with the transverse cuts 310 extend from the cuts 310 to a top edge 314 of shingle 300. The lines of weakness 308 may be perforations of various lengths, or may be a portion of the shingle that is thinner and thus easier to cut or tear. The cuts and lines of weakness 310, 308 separate the shingle 300 into first, second, and third offset portions 316, 318, 320. The offset portions 316, 318, 320 can be easily separated from each other by folding the shingle 300 along the lines of weakness 308 back and forth until the portions 316, 318, 320 separate. Alternatively, the lines of weakness 308 may be scored or cut. When cutting along the lines of weakness 308, the perforations help to guide a blade or other cutting device along a straight line.

The cuts 310 are spaced apart to form a first offset portion 316 having a width A, a second offset portion 318 having a width B, and a third offset portion 320 having a width C. In the illustrated embodiment, width A is one-sixth of the width of the full width shingle 300, width B is one-third (two-sixths) of the width of the full width shingle 300, and width C is one-half (three-sixths) of the width of the full width shingle 300. In some embodiments, the shingle 300 has a width of about 39 inches. In some embodiments, width A is about 6.5 inches, width B is about 13 inches, and width C is about 19.5 inches.

Figure 3A:
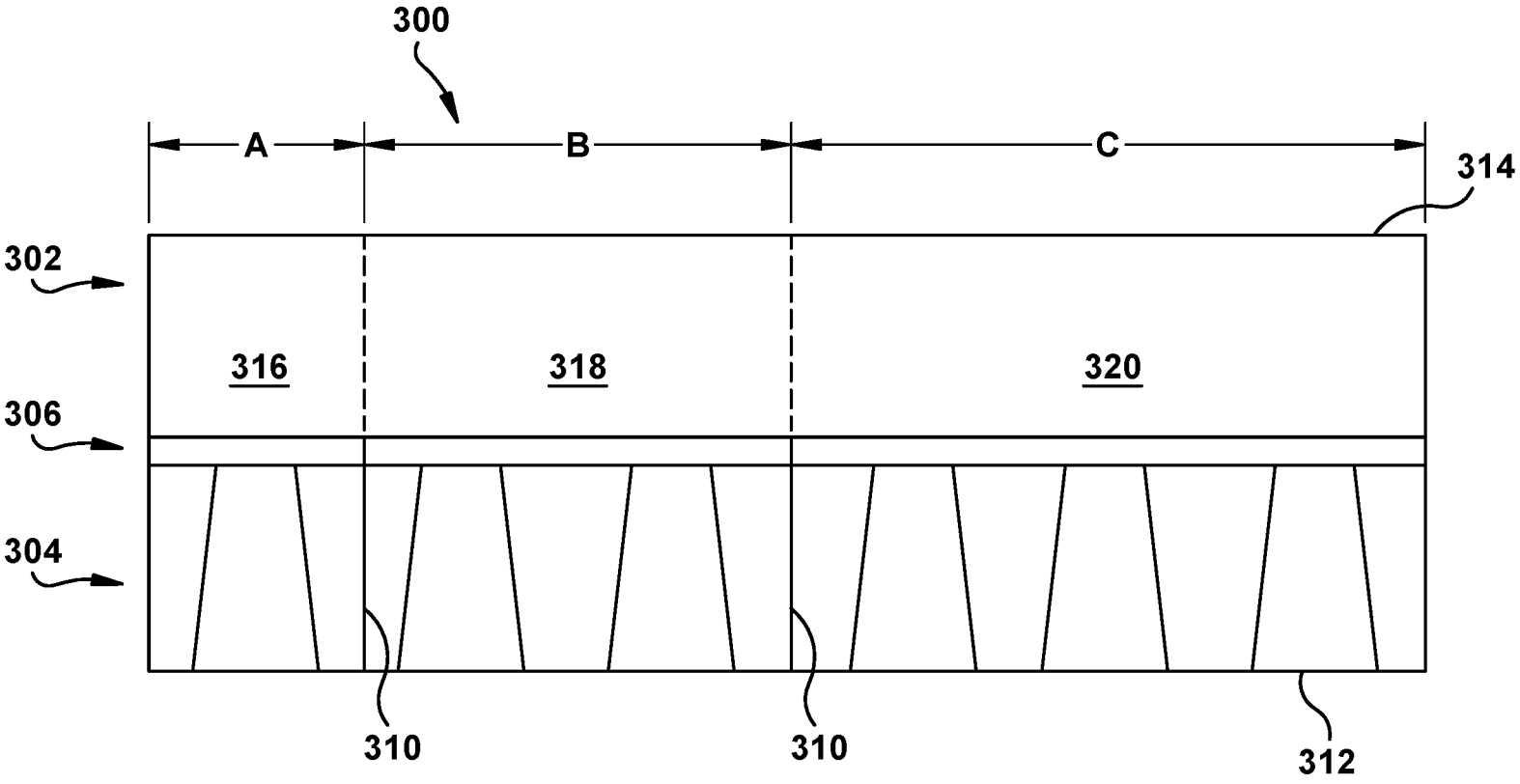
FIG. 3A is a plan view of an exemplary pre-cut prefabricated offset shingle.
Figure 4A:
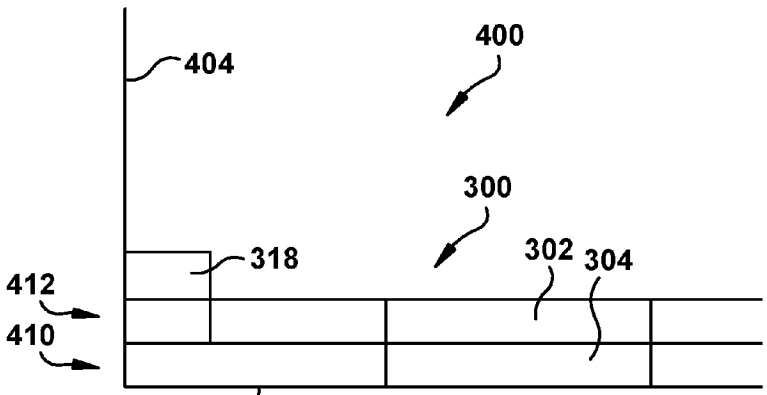
FIGS. 4A-4D illustrate the layout of shingle courses using exemplary prefabricated offset shingles.
Figure 4B:
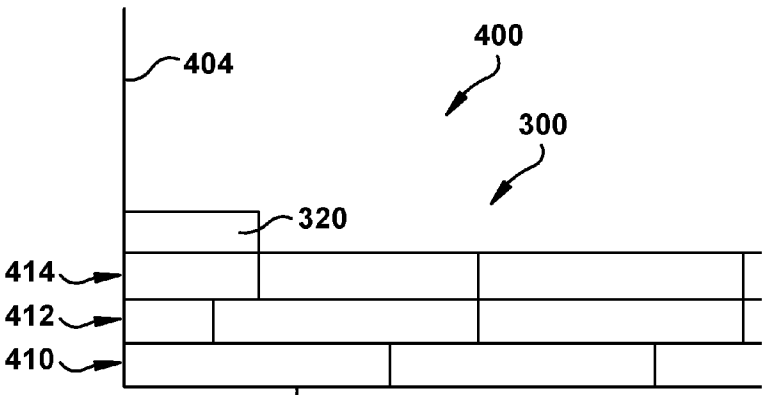
Figure 4C:
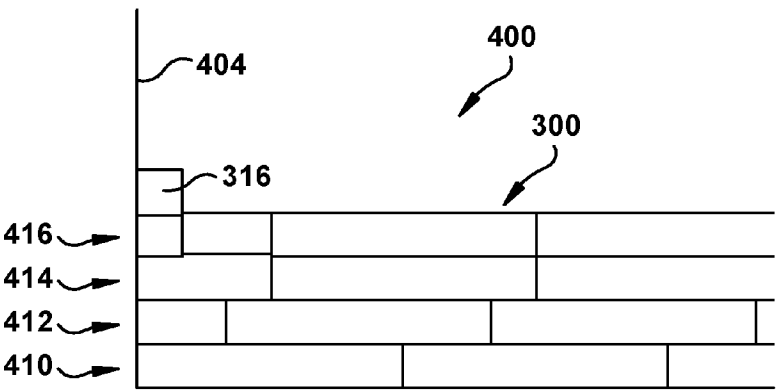
Figure 4D:
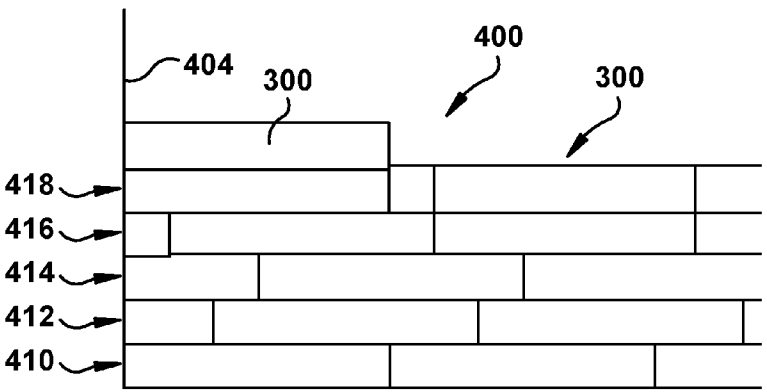

FIG. 3A illustrates an exemplary prefabricated offset shingle 300 that is the same as the embodiment of FIG. 3, except the shingle is completely pre-cut. That is, the transverse cuts 310 extend from a bottom edge 312 to the top edge 314 and the lines of weakness 308 are not included.

The offset portions may also be described as "steps" as they form a stair-step pattern when the offset shingles are attached to the roof in descending size order, i.e., starting with the largest step or offset on the first course, then the next smallest step, then the next smallest, etc. In the embodiment illustrated in FIG. 3, the offset shingle can be separated into three steps having three different sizes: small 316 (having width A), medium 318 (having width B), and large 320 (having width C). In an exemplary embodiment of an offset shingle having three steps, a formula is used to calculate a length $X_L$ of the longest shingle step (C in the example of FIG. 3), for a specified offset distance Y (corresponding to the smallest step A in the example of FIG. 3). The smallest step has a length $X_S$ and the medium step has a length $X_M$, with $X_S$ being equal to the offset distance Y, and $X_S$ being narrower than $X_M$ which in turn is narrower than $X_L$. The steps or offset shingles are made from an individual shingle having a given width of L, as is the case in the examples of FIGS. 3 and 3A. For most roofs of residential homes, the offset distance Y has practical bounds: at the lower end, the offset should be greater than about 2 inches to prevent water from penetrating the roof; and at the upper end, the offset should be less than or equal to about 6½ inches so that the smallest offset piece has a reasonable length. That said, larger offset distances may be desirable in buildings that are of a larger scale so that the shingle sizes maintain an appropriate aesthetic proportion with the rest of the structure.

The formula to calculate the longest off-set shingle piece length, $X_L$, is calculated in the following way. First, the total length L is defined as the sum of the step lengths, $X_L$, $X_M$, and $X_S$, as shown by Equation 1, below.

$$L=X_L+X_M+X_S \quad \text{(Equation 1)}$$

The relationship between the small and medium steps or offset portions can be defined in terms of the longest step and the offset length as follows:

$$X_M=X_L-Y \quad \text{(Equation 2); and}$$

$$X_S=X_L-2Y \quad \text{(Equation 3).}$$

These relationships are then substituted into Equation 1 which can be solved for $X_L$, thereby defining $X_L$ in terms of L and Y, which are known values:

$$L=X_L+(X_L-Y)+(X_L-2Y)$$

Solving for $X_L$ shows that:

$$X_L=L/3+Y$$

The small and medium steps, $X_S$ and $X_M$, can also be redefined in terms of L and Y by substituting this definition of $X_L$ into Equations 2 and 3 shown above.

$$X_M=L/3; \text{ and}$$

$$X_S=L/3-Y.$$

Referring now to FIGS. 4A-4D, diagrams showing the steps to install roof shingles 300 on a roof 400 are shown. The roof 400 includes a drip edge 402 and a rake edge 404. A first course 410 of full width shingles 300 is installed along the drip or bottom edge 402 of the roof 400. To start the second course 412, a second offset portion 318 is formed from a shingle 300. The remainder of the second course 412 is then completed with full width shingles 300. To start the third course 414, a third offset portion 320 is formed from a shingle 300. The remainder of the third course 414 is then completed with full width shingles 300. To start the fourth course 416, a first offset portion 316 is formed from a shingle 300. The remainder of the fourth course 416 is then completed with full width shingles 300. The fifth course 418 has no offset and is started with a full width shingle 300. In some embodiments, the offset portions 316, 318, 320 are arranged such that the widest offset portion 320 is used in the second course 412, the medium width offset portion 318 is used in the third course 414, and the narrowest offset portion 316 is used in the fourth course 416, with the pattern being continued up the roof so that each series of offset shingles forms a stair step pattern.

Figure 5:
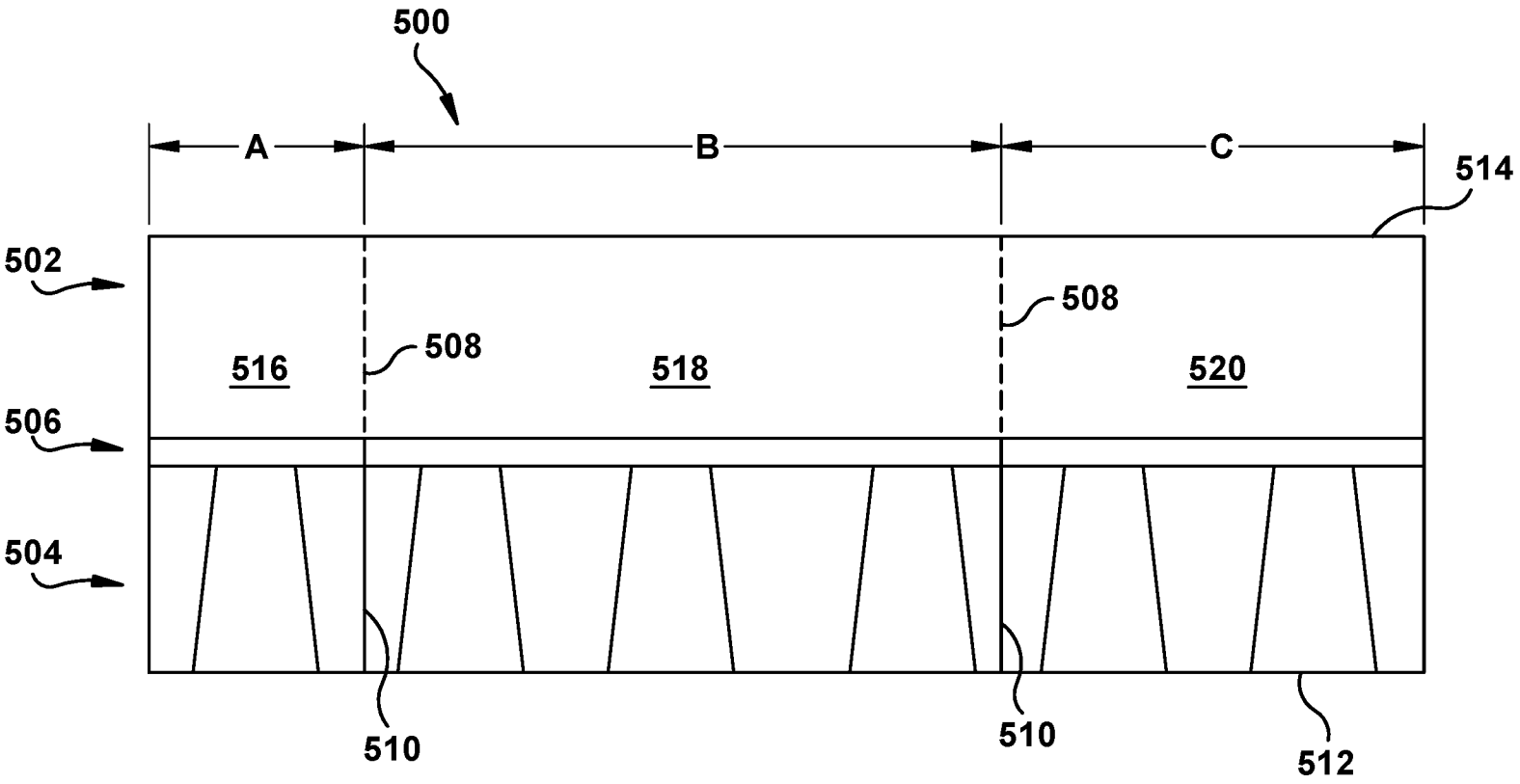
FIG. 5 is a plan view of an exemplary tearable prefabricated offset shingle.

Referring now to FIG. 5, an exemplary prefabricated offset shingle 500 is shown. The shingle 500 extends between first and second side edges and includes a headlap portion 502, a tab portion 504, and a nail zone 506. Transverse cuts 510 extend from a bottom edge 512 through the tab portion 504 and nail zone 506. Frangible lines of weakness 508 in line with the transverse cuts 510 extend from the cuts 510 to a top edge 514 of shingle 500. The lines of weakness 508 may be perforations of various lengths, or may be a portion of the shingle that is thinner and thus easier to cut or tear. The cuts and lines of weakness 510, 508 separate the shingle 500 into first, second, and third offset portions 516, 518, 520. The offset portions 516, 518, 520 can be easily separated from each other by folding the shingle 500 along the lines of weakness 508 back and forth until the portions 516, 518, 520 separate. Alternatively, the lines of weakness 508 may be scored or cut. When cutting along the lines of weakness 508, the perforations help to guide a blade or other cutting device along a straight line.

The two cuts 510 and lines of weakness 508 are spaced apart to form a first offset portion 516 having a width A, a second offset portion 518 having a width B, and a third offset portion 520 having a width C. In the illustrated embodiment, width A is one-sixth of the width of the full width shingle 500, width B is one-half (three-sixths) of the width of the full width shingle 500, and width C is one-third (two-sixths) of the width of the full width shingle 500. In some embodiments, the shingle 500 has a width of about 39 inches. In some embodiments, width A is about 6.5 inches, width B is about 19.5 inches, and width C is about 13 inches.

While the widths of offset portions 516, 518, 520 are similar to the offset portions 316, 318, 320 of shingle 300, arranging the one-half width portion in the middle of the one-sixth and one-third width portions allows the installer to create offset shingles in each one-sixth width increment up to the full width of the shingle. This allows the offset amount per course of shingles to be the same for each course, as shown in FIGS. 2A-2H. Table 1 below lists the combinations of offset portions 516, 518, 520 that form each offset shingle.

TABLE 1

| Offset Width | Offset Portion Combinations |
|---|---|
| 1/6 | A |
| 2/6 | C |
| 3/6 | B |
| 4/6 | A + B |
| 5/6 | B + C |

Figure 5A:
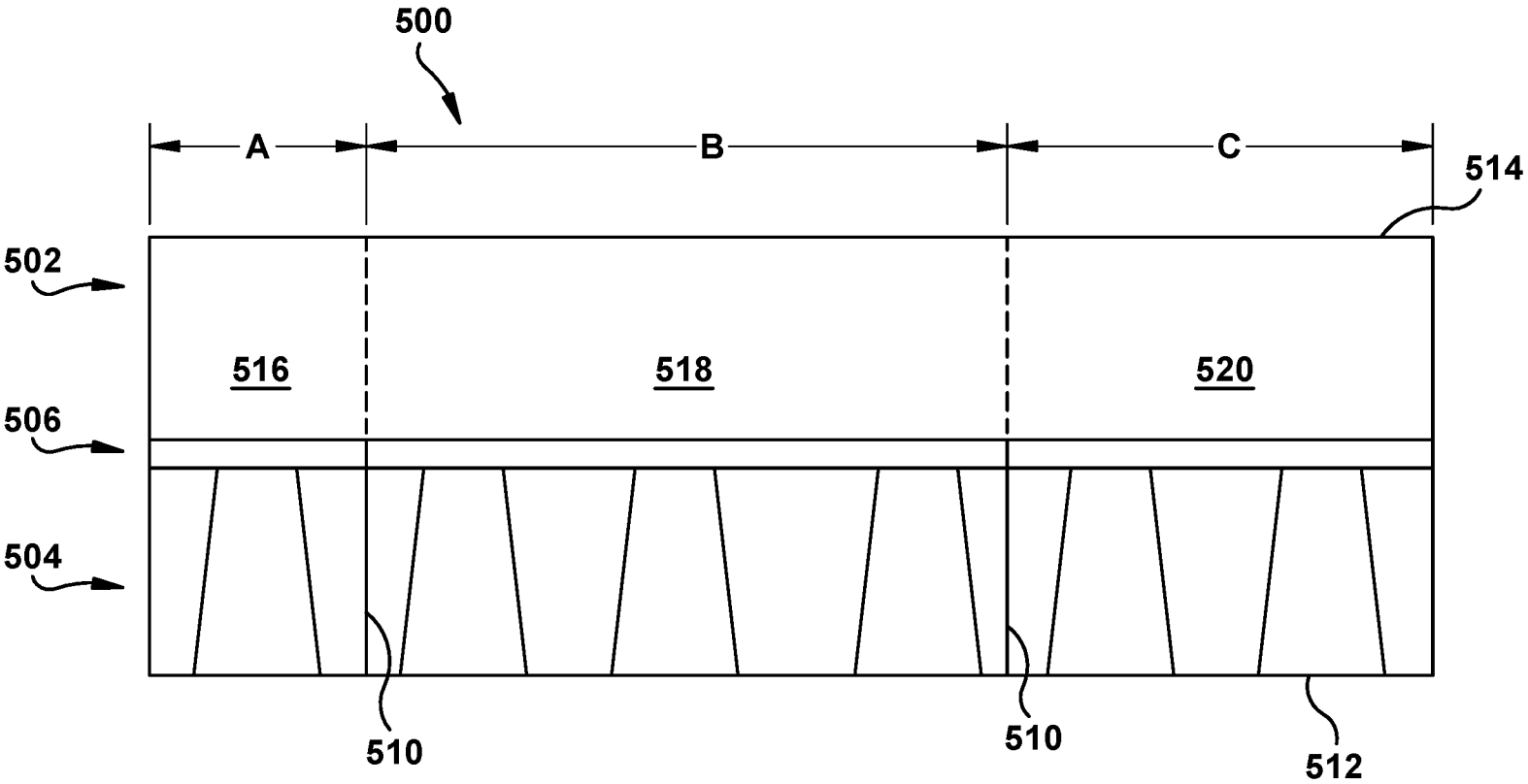
FIG. 5A is a plan view of an exemplary pre-cut prefabricated offset shingle.

FIG. 5A illustrates an exemplary prefabricated offset shingle 500 that is the same as the embodiment of FIG. 5, except the shingle is completely pre-cut. That is, the transverse cuts 510 extend from a bottom edge 512 to the top edge 514 and the lines of weakness 508 are not included.

Figure 6:
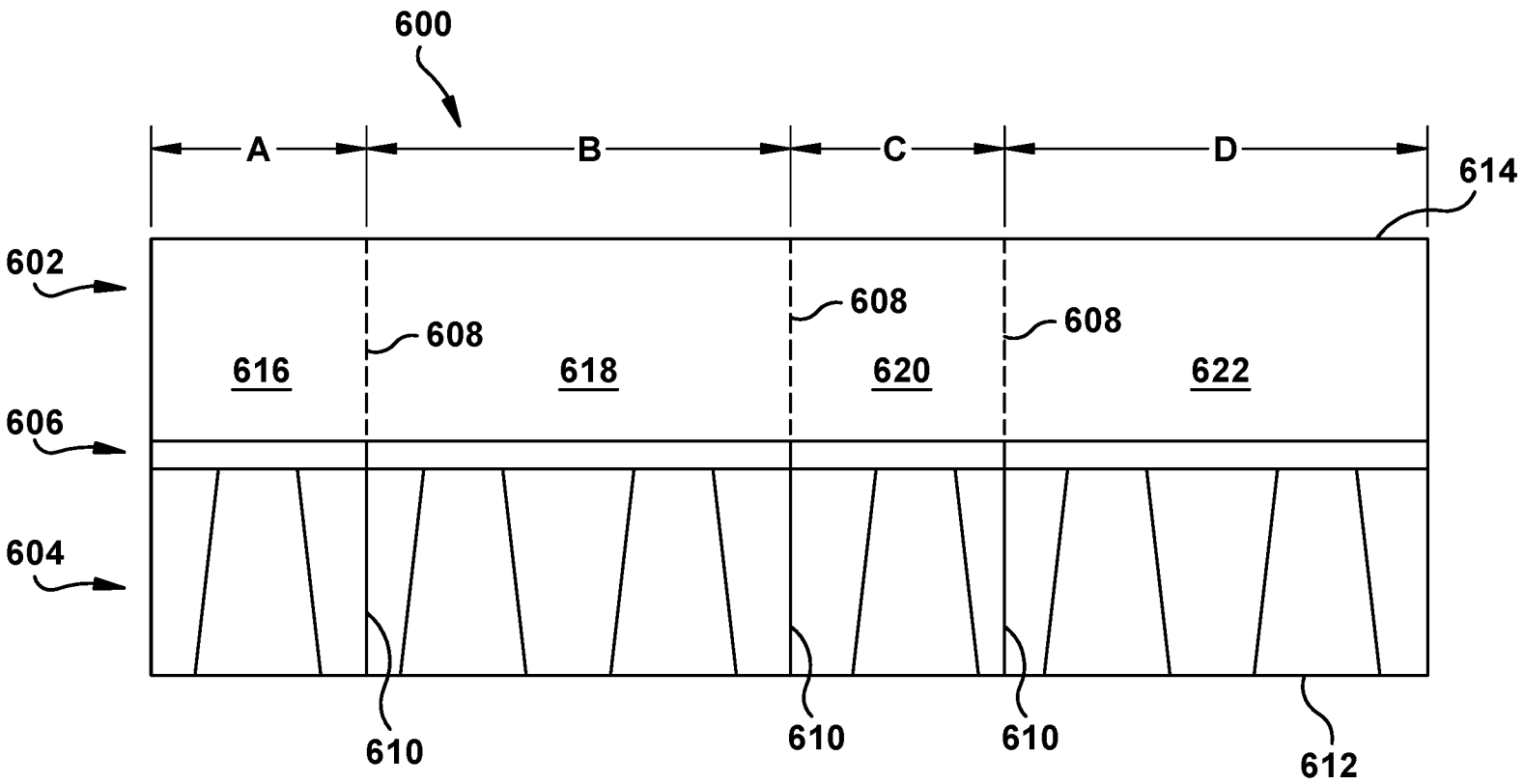
FIG. 6 is a plan view of an exemplary tearable prefabricated offset shingle.

Referring now to FIG. 6, an exemplary prefabricated offset shingle 600 is shown. The shingle 600 extends between first and second side edges and includes a headlap portion 602, a tab portion 604, and a nail zone 606. Transverse cuts 610 extend from a bottom edge 612 through the tab portion 604 and nail zone 606. Frangible lines of weakness 608 in line with the transverse cuts 610 extend from the cuts 610 to a top edge 614 of shingle 600. The lines of weakness 608 may be perforations of various lengths, or may be a portion of the shingle that is thinner and thus easier to cut or tear. The cuts and lines of weakness 610, 608 separate the shingle 600 into first, second, and third offset portions 616, 618, 620. The offset portions 616, 618, 620 can be easily separated from each other by folding the shingle 600 along the lines of weakness 608 back and forth until the portions 616, 618, 620 separate. Alternatively, the lines of weakness 608 may be scored or cut. When cutting along the lines of weakness 608, the perforations help to guide a blade or other cutting device along a straight line.

The three cuts 610 and lines of weakness 608 are spaced apart to form a first offset portion 616 having a width A, a second offset portion 618 having a width B, a third offset portion 620 having a width C, and a fourth offset portion 622 having a width D. Widths A and C are equal, and widths B and D are equal. In the illustrated embodiment, widths A and C are one-sixth of the width of the full width shingle 600, and widths B and D are one-third (two-sixths) of the width of the full width shingle 600. In some embodiments, the shingle 600 has a width of about 39 inches. In some embodiments, widths A and C are about 6.5 inches, and widths B and D are about 13 inches.

Alternating the positions of the smaller and larger size shingles allows the installer to create offset shingles in each one-sixth width increment up to the full width of the shingle. This allows the offset amount per course of shingles to be the same for each course, as shown in FIGS. 2A-2H. Table 2 below lists the combinations of offset portions 616, 618, 620, 622 that form each offset shingle.

TABLE 2

| Offset Width | Offset Portion Combinations |
|---|---|
| 1/6 | A |
| 2/6 | D |
| 3/6 | A + B |
| 4/6 | A + B + C |
| 5/6 | B + C + D |

Figure 6A:
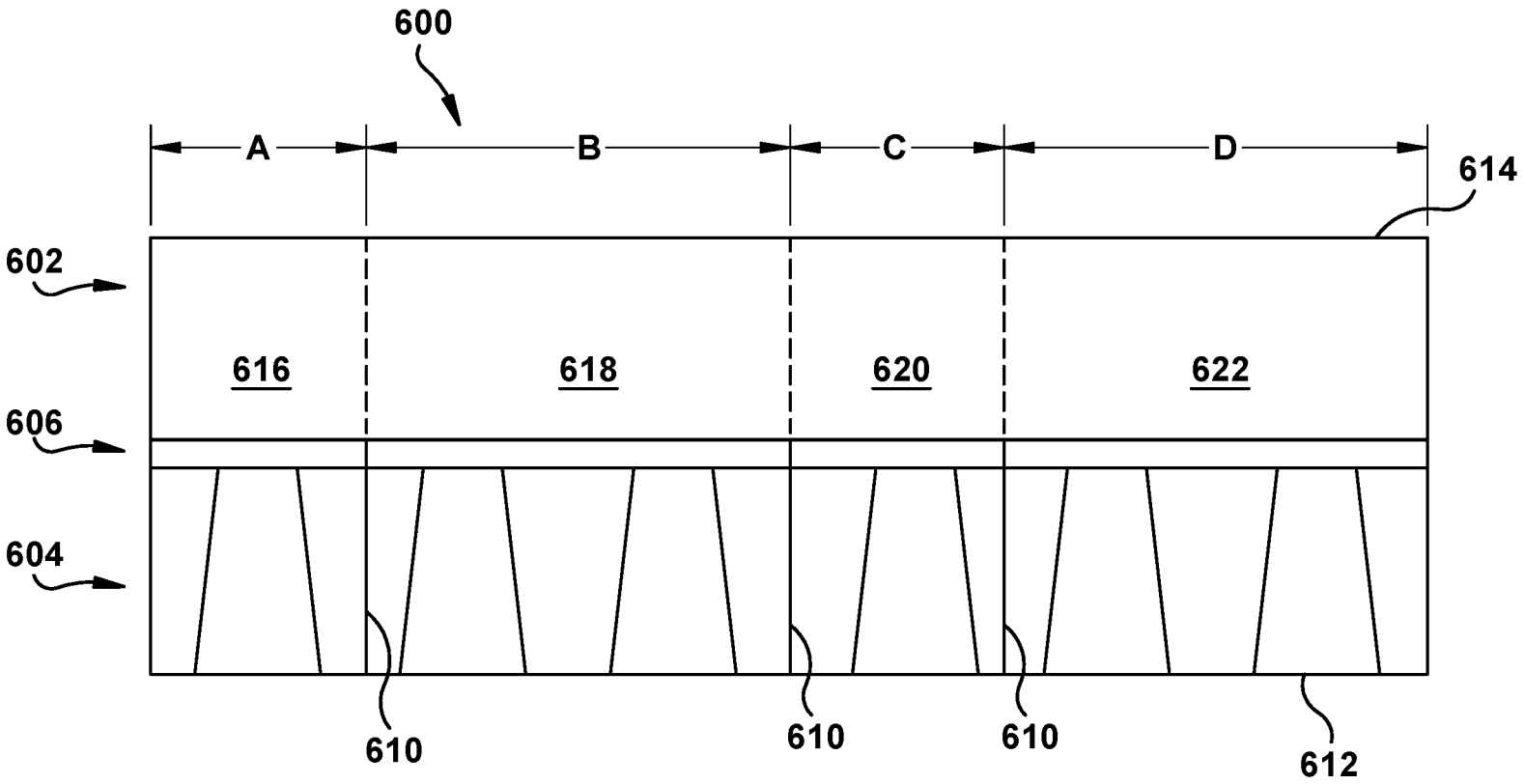
FIG. 6A is a plan view of an exemplary pre-cut prefabricated offset shingle.

FIG. 6A illustrates an exemplary prefabricated offset shingle 600 that is the same as the embodiment of FIG. 6, except the shingle is completely pre-cut. That is, the transverse cuts 610 extend from a bottom edge 612 to the top edge 614 and the lines of weakness 608 are not included.

Figure 7:
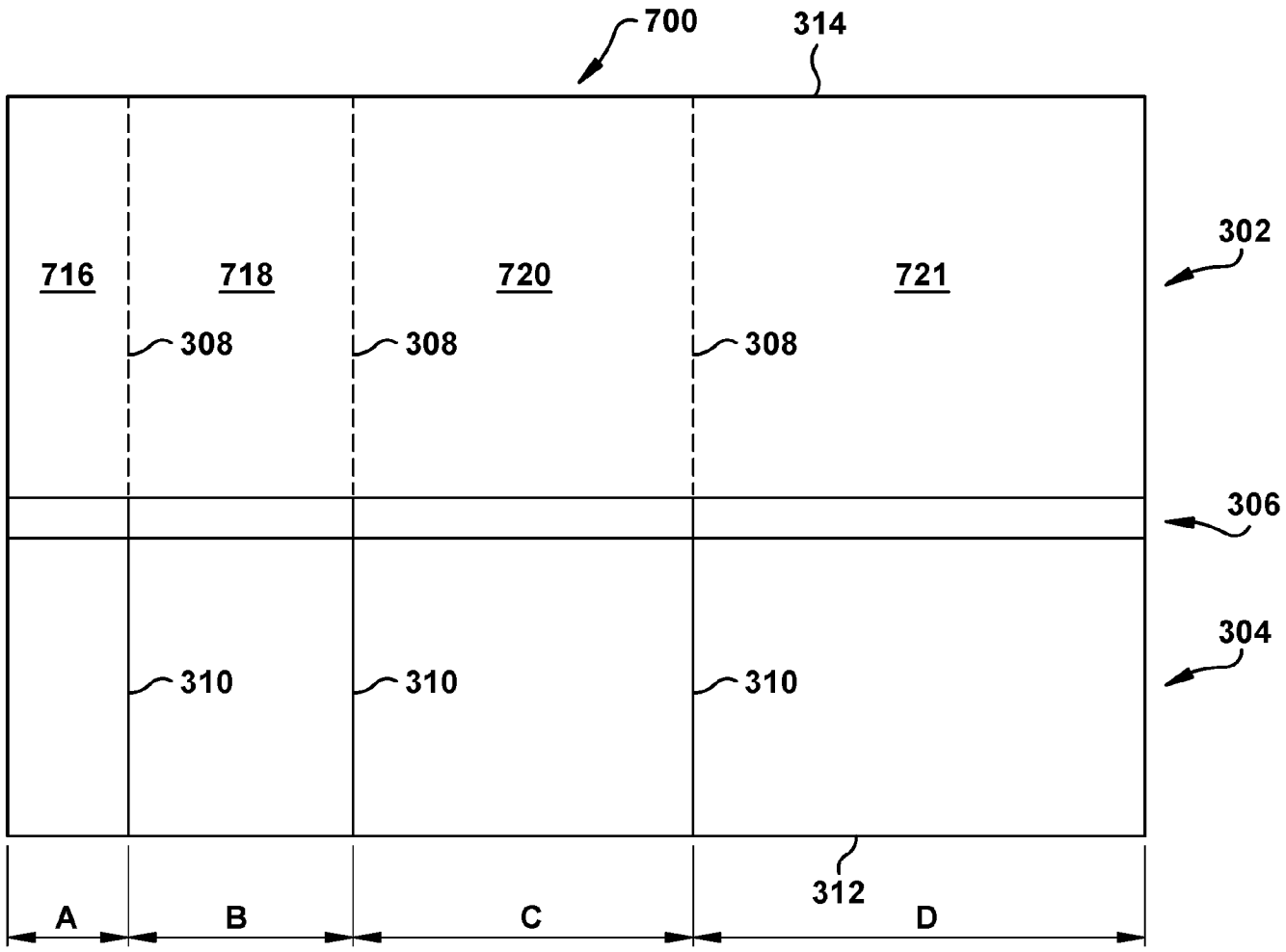
FIG. 7 is a plan view of an exemplary tearable prefabricated offset shingle.

Referring now to FIG. 7, an exemplary prefabricated offset shingle 700 is shown. The shingle 700 extends between first and second side edges and includes a headlap portion 702, a tab portion 704, and a nail zone 706. Transverse cuts 710 extend from a bottom edge 712 through the tab portion 704 and nail zone 706. Frangible lines of weakness 708 in line with the transverse cuts 710 extend from the cuts 710 to a top edge 714 of shingle 700. The lines of weakness 708 may be perforations of various lengths, or may be a portion of the shingle that is thinner and thus easier to cut or tear. The cuts and lines of weakness 710, 708 separate the shingle 700 into first, second, third and fourth offset portions 716, 718, 720, and 721. The offset portions 716, 718, 720, and 721 can be easily separated from each other by folding the shingle 700 along the lines of weakness 708 back and forth until the portions 716, 718, 720, and 721 separate. Alternatively, the lines of weakness 708 may be scored or cut. When cutting along the lines of weakness 708, the perforations help to guide a blade or other cutting device along a straight line.

The cuts 710 are spaced apart to form a first offset portion 716 having a width A, a second offset portion 718 having a width B, a third offset portion 720 having a width C, and a fourth offset portion 721 having a width D. In the illustrated embodiment, width A is one-tenth of the width of the full width shingle 700, width B is one-fifth (two-tenths) of the width of the full width shingle 700, width C is three-tenths of the width of the full width shingle 700, and width D is two-fifths (four-tenths) of the width of the full width shingle 700. In some embodiments, the shingle 700 has a width of about 39 or 40 inches. In some embodiments, width A is about 4 inches, width B is about 8 inches, width C is about 12 inches, and width D is about 16 inches.

Figure 7A:
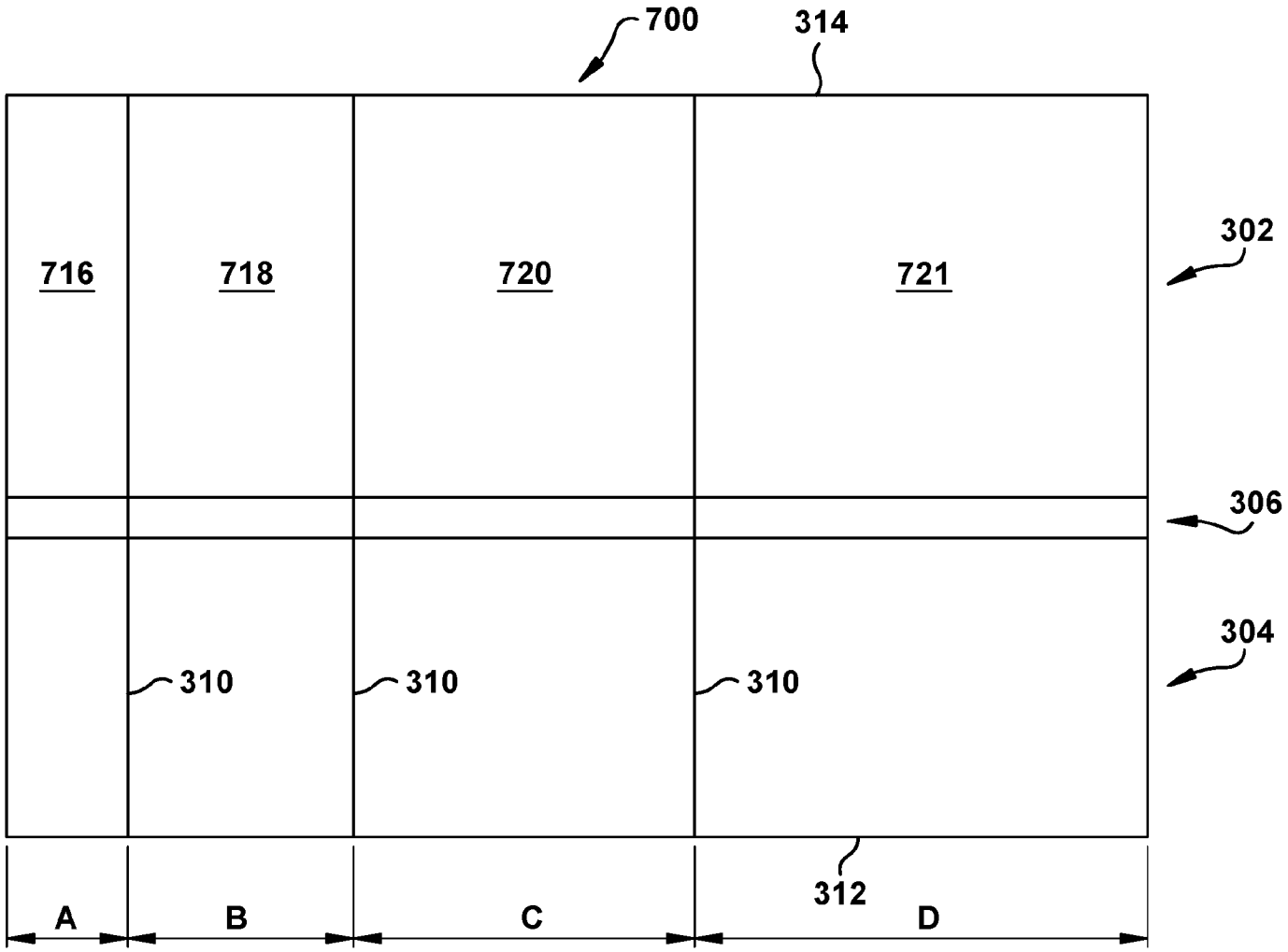
FIG. 7A is a plan view of an exemplary pre-cut prefabricated offset shingle.

FIG. 7A illustrates an exemplary prefabricated offset shingle 700 that is the same as the embodiment of FIG. 7, except the shingle is completely pre-cut. That is, the transverse cuts 710 extend from a bottom edge 712 to the top edge 714 and the lines of weakness 708 are not included.

The different portions of the prefabricated offset shingles illustrated by FIGS. 7 and 7A may be in any order. That is, the order may be varied in the same manner as described with respect to the embodiments of FIGS. 3, 3A, 5, 5A, 6, and 6A.

In the embodiment illustrated in FIGS. 7 and 7A, the offset shingle can be separated into four steps having four different sizes. In an exemplary embodiment of an offset shingle having four steps, a formula is used to calculate a length $X_D$ of the longest shingle step (D in the example of FIG. 7), for a specified offset distance Y (corresponding to the smallest step A in the example of FIG. 7). The other steps, in descending size order, have widths $X_C$, $X_B$, and $X_A$ (equal to offset Y). The steps or offset shingles are made from an individual shingle having a given width of L, as is the case in the examples of FIGS. 7 and 7A. For most roofs of residential homes, the offset distance Y has practical bounds: at the lower end, the offset should be greater than about 2 inches to prevent water from penetrating the roof; and at the upper end, the offset should be less than or equal to about 6½ inches so that the smallest offset piece has a reasonable length. That said, larger offset distances may be desirable in buildings that are of a larger scale so that the shingle sizes maintain an appropriate aesthetic proportion with the rest of the structure.

The formula to calculate the longest off-set shingle piece length, $X_L$, is calculated in the following way. First, the total length L is defined as the sum of the step lengths, $X_L$, $X_M$, and $X_S$, as shown by Equation 1, below.

$$L=X_A+X_B+X_C+X_D \quad \text{(Equation 1)}$$

The relationship between the small and medium steps or offset portions can be defined in terms of the longest step and the offset length as follows:

$$X_A=X_D-3Y \quad \text{(Equation 2);}$$

$$X_B=X_D-2Y \quad \text{(Equation 3); and}$$

$$X_C=X_D-Y \quad \text{(Equation 4).}$$

These relationships are then substituted into Equation 1 which can be solved for $X_L$, thereby defining $X_L$ in terms of L and Y, which are known values:

$$L=(X_D-3Y)+(X_D-2Y)+(X_D-Y)+X_D$$

Solving for $X_D$ shows that:

$$X_D=(L+6Y)/4$$

The smaller steps, $X_A$, $X_B$, and $X_C$, can also be redefined in terms of L and Y by substituting this definition of $X_D$ into Equations 2, 3, and 4 shown above.

$$X_A=(L-6Y)/4;$$

$$X_B=(L-2Y)/4; \text{ and}$$

$$X_C=(L+2Y)/4.$$

While the prefabricated offset shingles 300, 500, 600, and 700 described above have offset portions of different widths, the offset portions may be the same width and be formed by cuts that are uniformly spaced across the width of the shingle. Furthermore, the different sized portions do not have to be multiples of the smallest portion—e.g., one-sixth of the width of the shingle. For example, a small offset portion may be 15 percent of the width of the full width shingle, a medium offset portion may be 35 percent of the width of a full width shingle, and a large offset portion may be 50 percent of the width of a full width shingle.

Figure 8A:
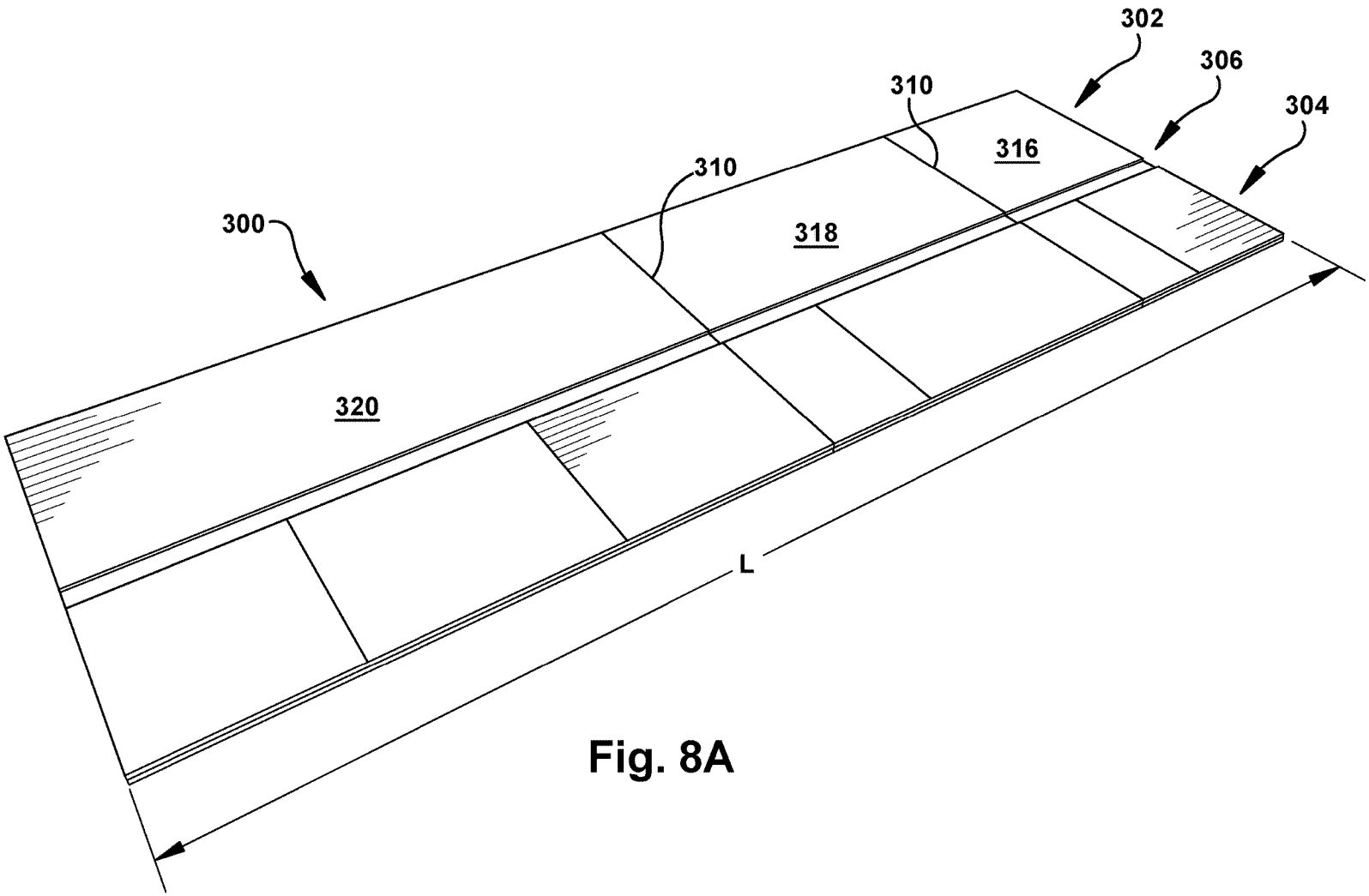
FIGS. 8A-8G illustrate packaging of pre-cut prefabricated offset shingles.
Figure 8B:
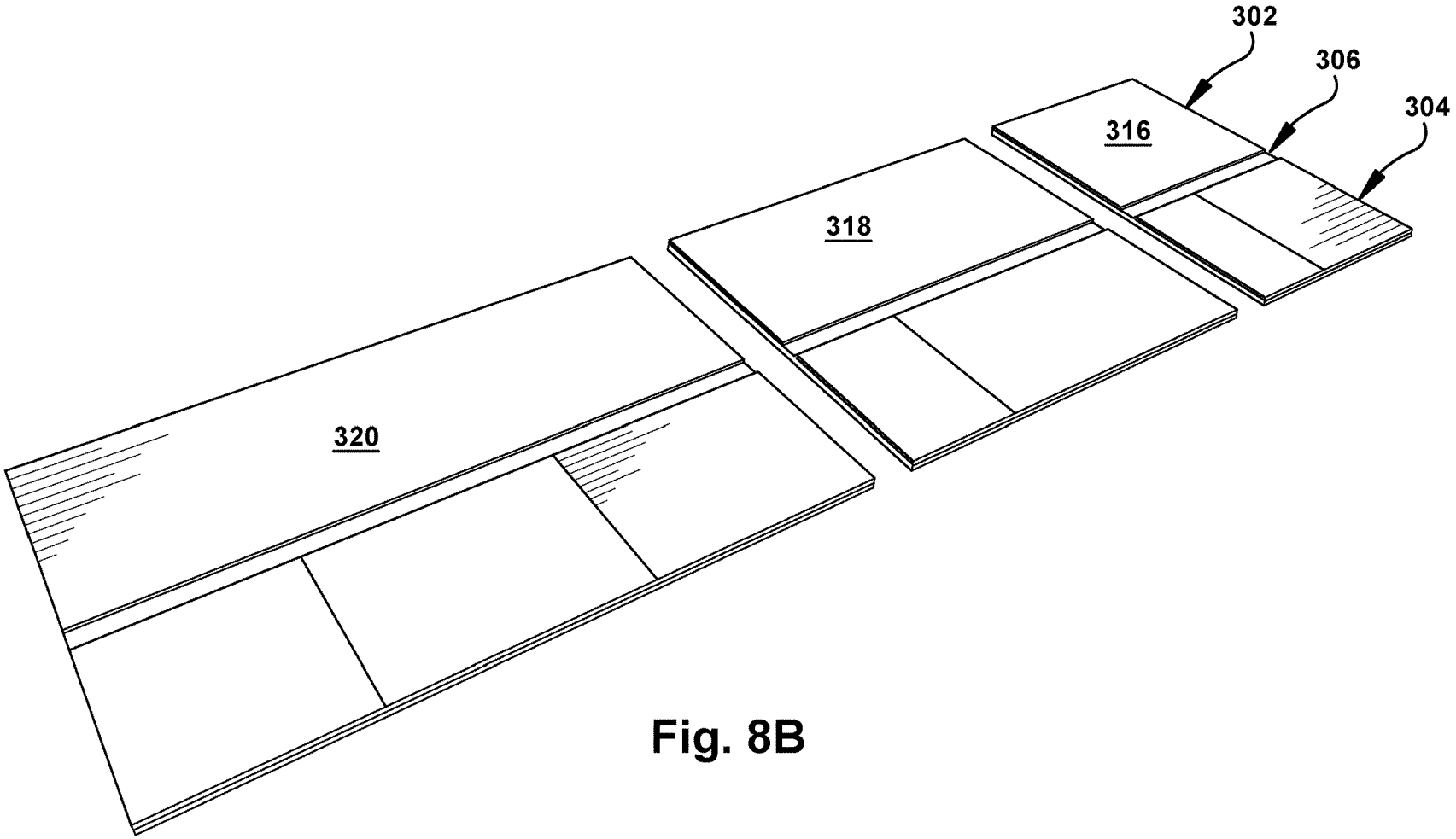

The pre-cut prefabricated shingles illustrated by FIGS. 3A, 5A, 6A, and 7A may be packaged in a box having an interior length L/2 that is approximately one-half the length L of the shingle 300. FIGS. 8A and 8B illustrate the shingle 300 cut and separated into segments 316, 318, and 320. The segment 320 is one-half the length L or about one-half the length L of the shingle. The combined length of the segments 316, 318 is also one-half the length L or about one-half the length L of the shingle 300.

Figure 8C:
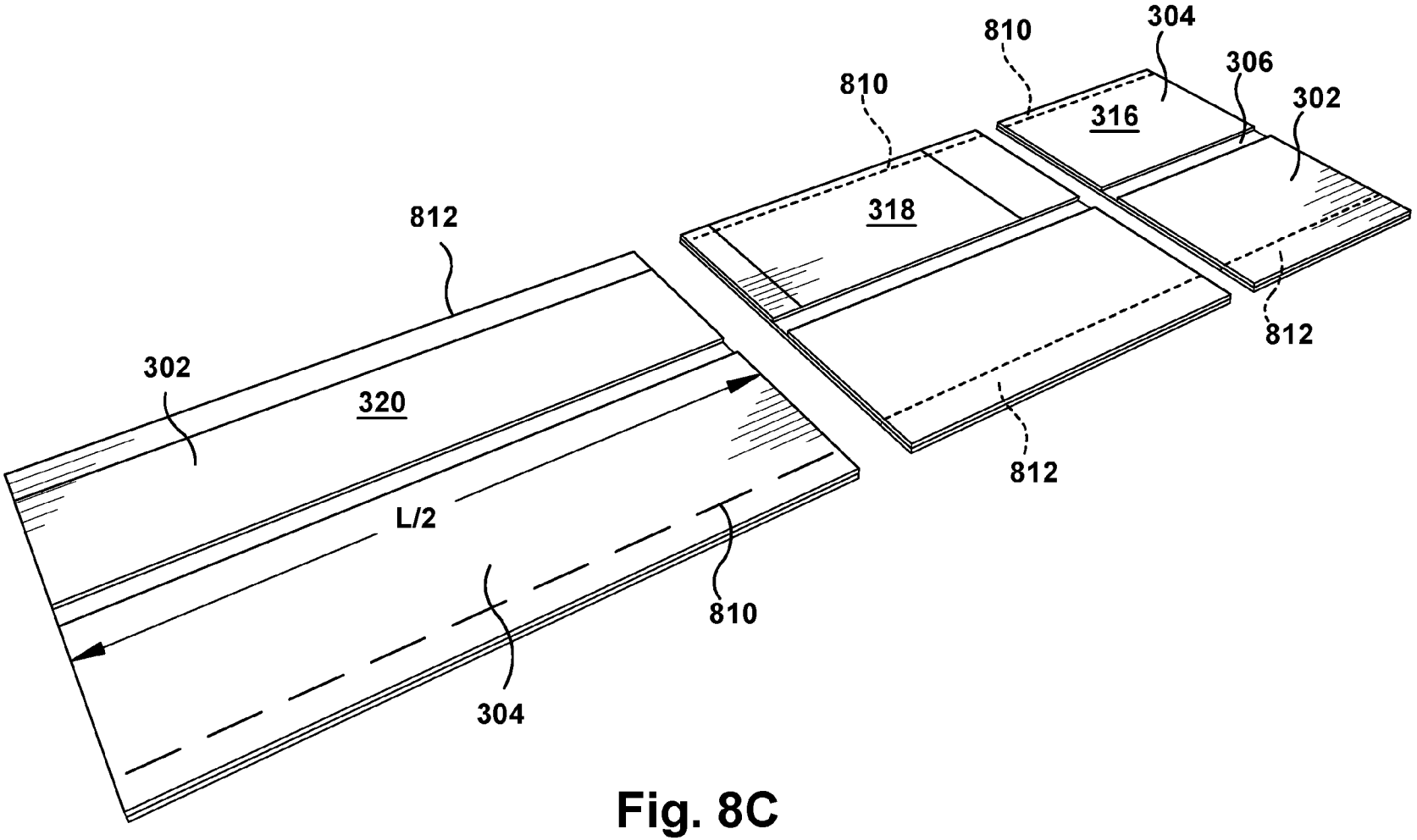
Figure 8D:
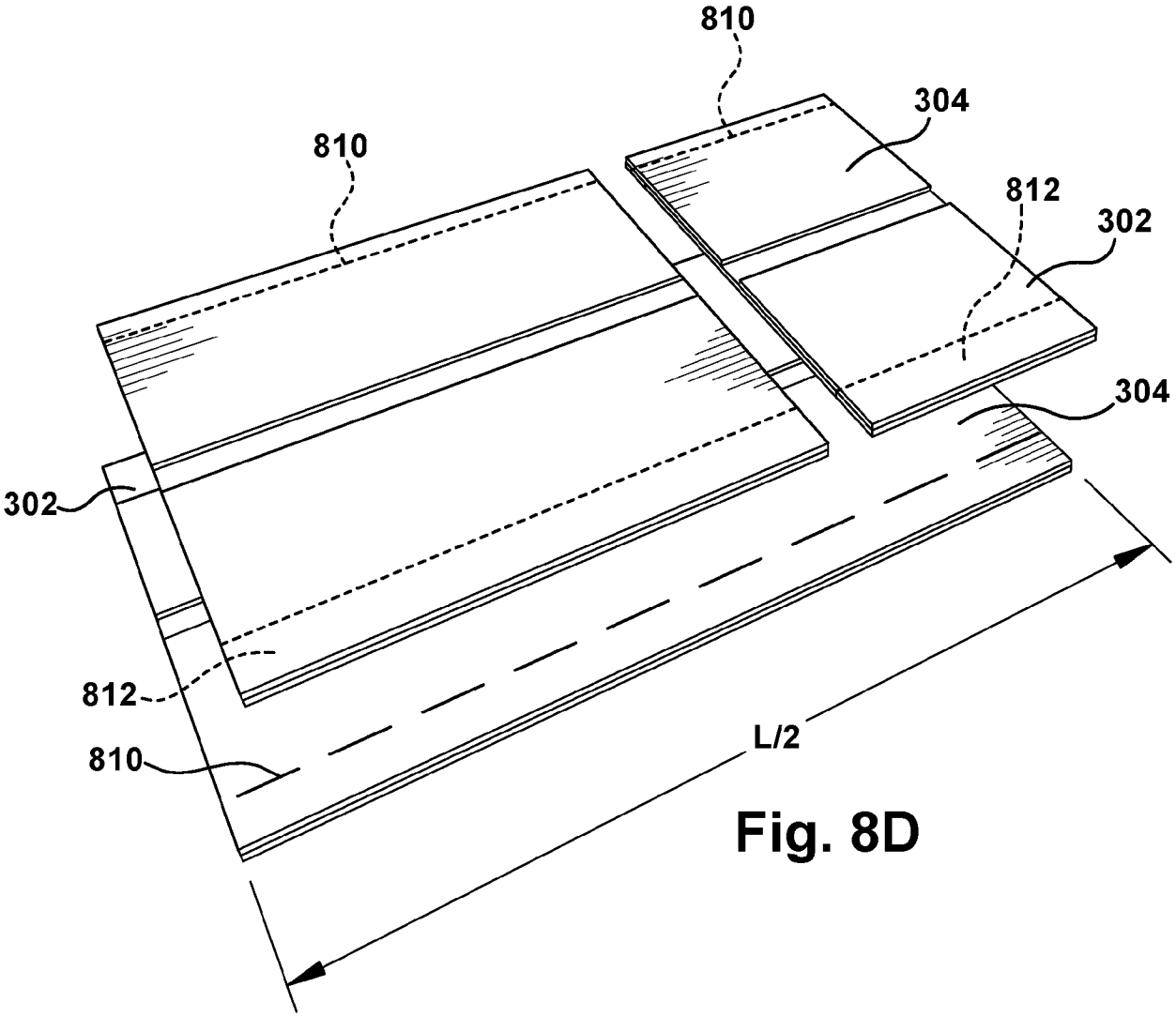
Figure 8E:
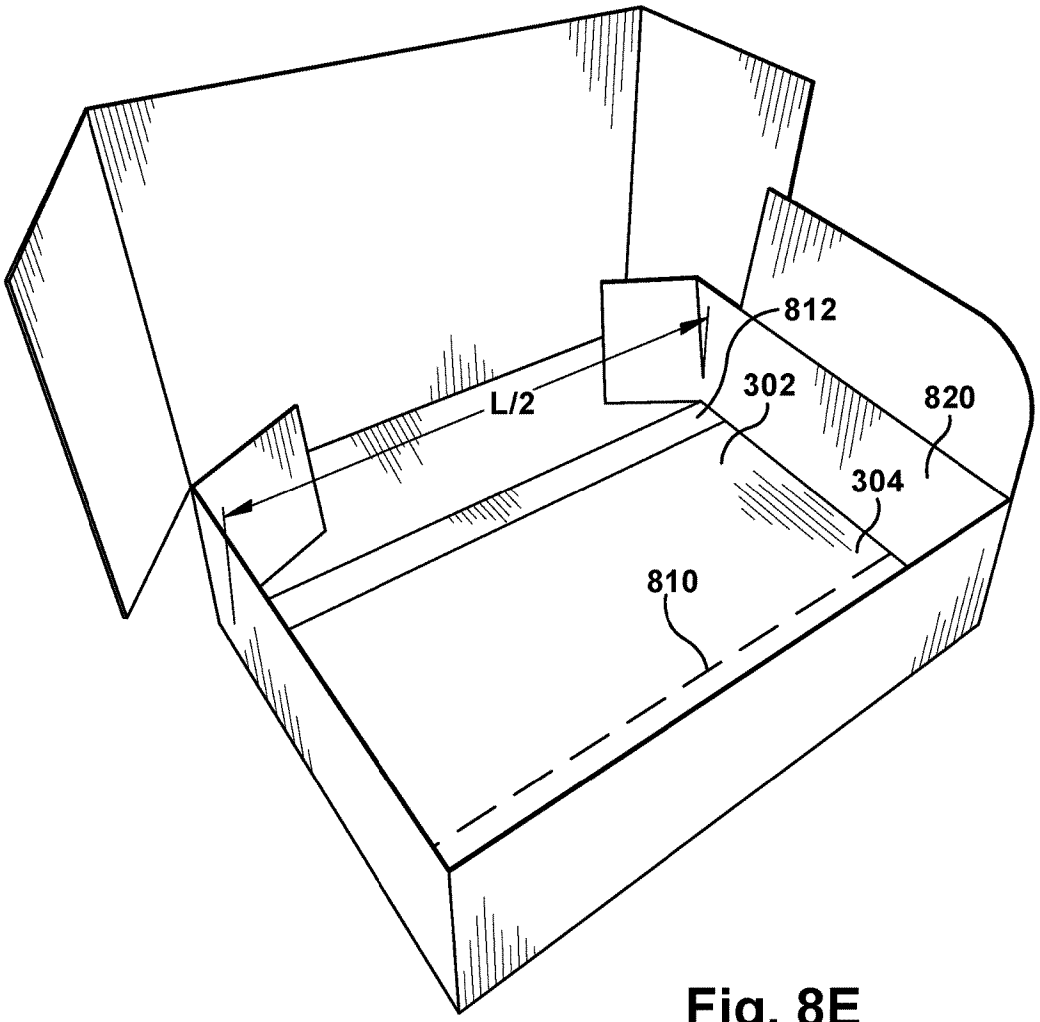
Figure 8F:
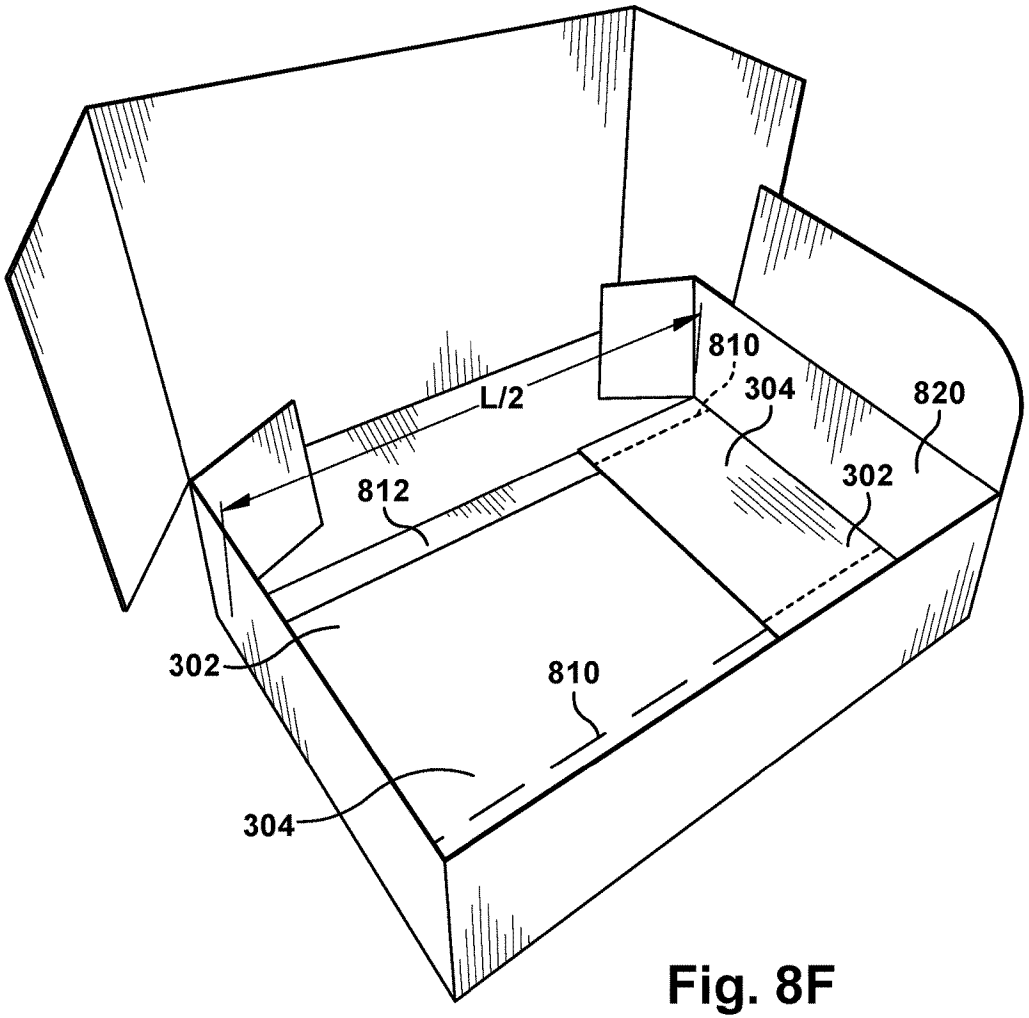
Figure 8G:
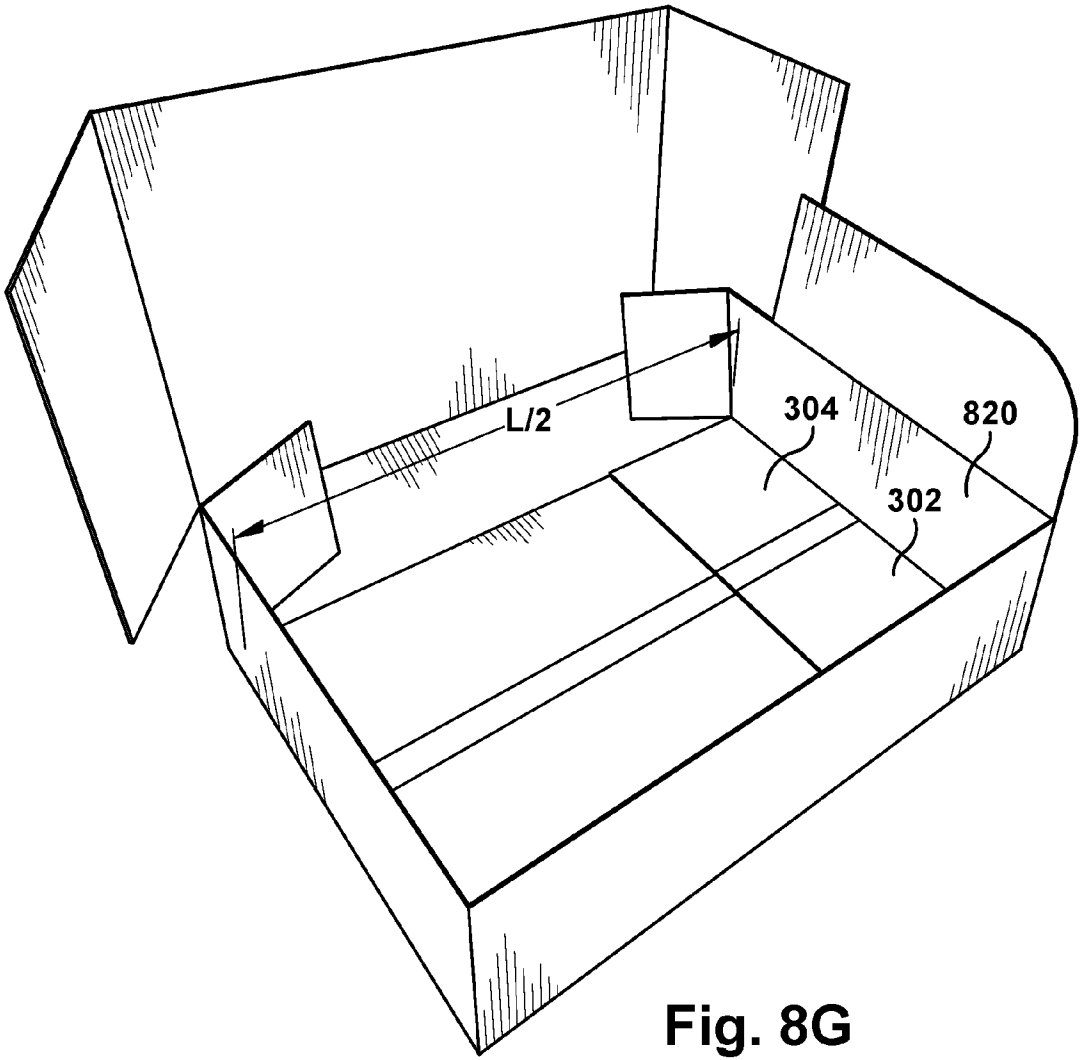

Referring now to FIGS. 8C and 8D, a rear surface of the shingle segments 316, 318, 320 has a sealant 810 proximate the bottom edge and a release tape 812 proximate the top edge. In FIGS. 8C and 8D, the segment 320 is flipped over, so that a sealant 810 of the segment 320 is aligned with the release tape 812 of the segments 316, 318 and the sealant 810 of the segments 316, 318 is aligned with the release tape 812 of segment 320. Referring to FIGS. 8E-8G, the shingle 300 is placed in the box 820 in this release tape/sealant aligned orientation. As such, each shingle 300 can be placed in the illustrated two-layer stack in a box having an interior length L/2 that is one-half or about one-half the length L of the shingle 300. Additional shingles can be stacked in the box in this configuration to fill the box.

The shingle 700 illustrated by FIG. 7A may also be packaged in a box having an interior length L/2 that is approximately one-half the length L of the shingle 300. FIG. 7A illustrates the shingle 700 cut and separated into segments 716, 718, 720, and 721. The combined lengths of the segments 716 and 721 is one-half the length L or about one-half the length L of the shingle 700. The combined length of the segments 718, 720 is also one-half the length L or about one-half the length L of the shingle 700. Each pair (716-721 and 718-720) of shingle segments can be oriented and stacked in the box 820 in the same manner illustrated by FIGS. 8E-8G. The sealant 810 of each shingle segment is aligned with the release tape 812 of each opposing shingle segment to prevent the shingle segments from sticking together.

Figure 9A:
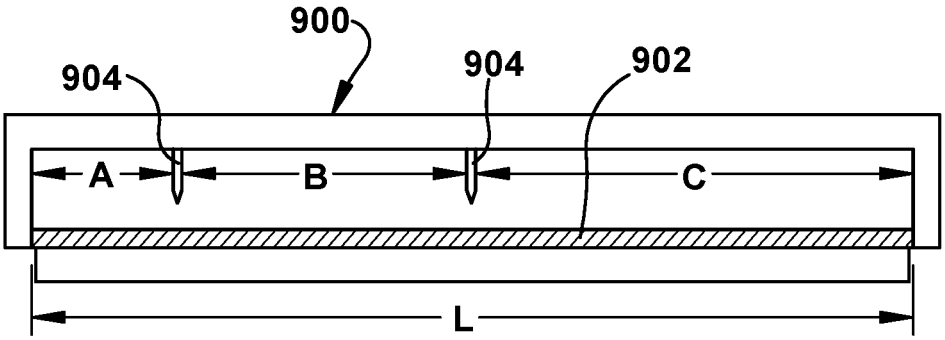
FIGS. 9A-9C illustrate an exemplary embodiment of a cutter for making offset shingles from a traditional shingle.
Figure 9B:
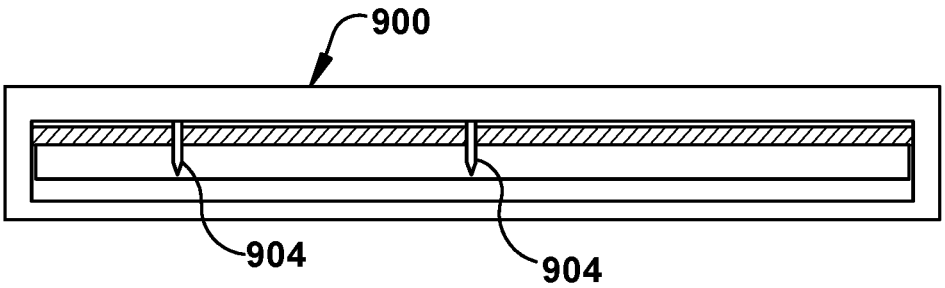
Figure 9C:
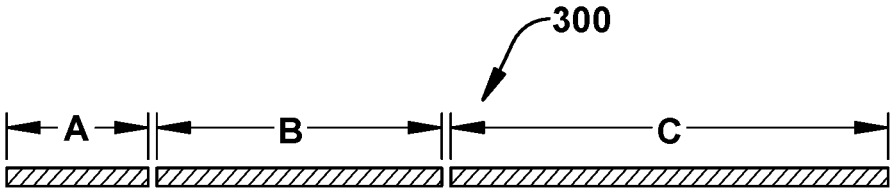

The shingles disclosed by the present application can be made in a wide variety of different ways. Referring to FIG. 9A, a shingle blank 902 having a length L may be provided to a cutter 900. The cutter 900 includes spaced apart blades 904. The blades 904 may be configured to make any of the cuts and lines of weakness described in this patent application. The number of blades and spacing of the blades 904 may be set to the size of each offset segment. For example, the number of blades and spacing may correspond to the sizes A, B, and C of FIGS. 3 and 3A as illustrated, the number of blades and spacing of FIGS. 5, 5A, 6, 6A, 7, or 7A or any other offset shingle configuration. Referring to FIG. 9B, the cutter 900 moves the blades 904 to cut the blank 902 into the segments. Referring to FIG. 9C, the segments are then released from the cutter.

While various inventive aspects, concepts and features of the disclosures may be described and illustrated herein as embodied in combination in the exemplary embodiments, these various aspects, concepts, and features may be used in many alternative embodiments, either individually or in various combinations and sub-combinations thereof. Unless expressly excluded herein all such combinations and sub-combinations are intended to be within the scope of the present application. Still further, while various alternative embodiments as to the various aspects, concepts, and features of the disclosures—such as alternative materials, structures, configurations, methods, devices, and components, alternatives as to form, fit, and function, and so on—may be described herein, such descriptions are not intended to be a complete or exhaustive list of available alternative embodiments, whether presently known or later developed. Those skilled in the art may readily adopt one or more of the inventive aspects, concepts, or features into additional embodiments and uses within the scope of the present application even if such embodiments are not expressly disclosed herein. Additionally, even though some features, concepts, or aspects of the disclosures may be described herein as being a preferred arrangement or method, such description is not intended to suggest that such feature is required or necessary unless expressly so stated. Still further, exemplary or representative values and ranges may be included to assist in understanding the present application, however, such values and ranges are not to be construed in a limiting sense and are intended to be critical values or ranges only if so expressly stated. Moreover, while various aspects, features and concepts may be expressly identified herein as being inventive or forming part of a disclosure, such identification is not intended to be exclusive, but rather there may be inventive aspects, concepts, and features that are fully described herein without being expressly identified as such or as part of a specific disclosure, the disclosures instead being set forth in the appended claims. Descriptions of exemplary methods or processes are not limited to inclusion of all steps as being required in all cases, nor is the order that the steps are presented to be construed as required or necessary unless expressly so stated. The words used in the claims have their full ordinary meanings and are not limited in any way by the description of the embodiments in the specification.

What is claimed is:

1. An offset shingle comprising:

a headlap portion extending from a top edge to a tab portion, the tab portion extending from the headlap portion to a bottom edge, the headlap portion and the tab portion extending between first and second side edges; and two transverse cuts extending from the bottom edge to the headlap portion; and frangible lines of weakness in line with the transverse cuts, the lines of weakness extending from the transverse cuts to the top edge;

wherein the cuts and lines of weakness separate the shingle into first, second, and third offset portions having first, second, and third widths;

wherein the first width is equal to an offset distance;

wherein the second width is greater than the first width by at least the offset distance; and wherein the third width is greater than the second width by at least the offset distance and the third width is equal to the sum of the first and second widths.

2. The offset shingle of claim 1, wherein the cuts extend from the bottom edge to the top edge.

3. An offset shingle comprising:

a headlap portion extending from a top edge to a tab portion, the tab portion extending from the headlap portion to a bottom edge, the headlap portion and the tab portion extending between first and second side edges; and two transverse cuts extending from the bottom edge to the headlap portion; and frangible lines of weakness in line with the transverse cuts, the lines of weakness extending from the transverse cuts to the top edge;

wherein the cuts and lines of weakness separate the shingle into first, second, and third offset portions having first, second, and third widths;

wherein the first width is equal to an offset distance;

wherein the second width is greater than the first width by at least the offset distance;

wherein the third width is greater than the second width by at least the offset distance; and wherein the offset distance is about one-sixth of a total width of the offset shingle.

4. An offset shingle comprising:

a headlap portion extending from a top edge to a tab portion, the tab portion extending from the headlap portion to a bottom edge, the headlap portion and the tab portion extending between first and second side edges; and two transverse cuts extending from the bottom edge to the headlap portion; and frangible lines of weakness in line with the transverse cuts, the lines of weakness extending from the transverse cuts to the top edge;

wherein the cuts and lines of weakness separate the shingle into first, second, and third offset portions having first, second, and third widths;

wherein the first width is equal to an offset distance;

wherein the second width is greater than the first width by at least the offset distance;

wherein the third width is greater than the second width by at least the offset distance and the third width is equal to one-half of a total width of the offset shingle between the first and second side edges.

5. An offset shingle comprising:

a headlap portion extending from a top edge to a tab portion, the tab portion extending from the headlap portion to a bottom edge, the headlap portion and the tab portion extending between first and second side edges; and three transverse cuts extending from the bottom edge to the headlap portion; and frangible lines of weakness in line with the transverse cuts, the lines of weakness extending from the transverse cuts to the top edge;

wherein the cuts and lines of weakness separate the shingle into first, second, third, and fourth offset portions having first, second, third, and fourth widths;

wherein the first width is equal to an offset distance;

wherein the second width is greater than the first width by at least the offset distance;

wherein the third width is greater than the second width by at least the offset distance; and wherein the fourth width is greater than the third width by at least the offset distance and the fourth width is equal to the sum of the first, second, and third widths.

6. The offset shingle of claim 5, wherein the cuts extend from the bottom edge to the top edge.

7. An offset shingle comprising:

a headlap portion extending from a top edge to a tab portion, the tab portion extending from the headlap portion to a bottom edge, the headlap portion and the tab portion extending between first and second side edges; and three transverse cuts extending from the bottom edge to the headlap portion; and frangible lines of weakness in line with the transverse cuts, the lines of weakness extending from the transverse cuts to the top edge;

wherein the cuts and lines of weakness separate the shingle into first, second, third, and fourth offset portions having first, second, third, and fourth widths;

wherein the first width is equal to an offset distance;

wherein the second width is greater than the first width by at least the offset distance;

wherein the third width is greater than the second width by at least the offset distance;

wherein the fourth width is greater than the third width by at least the offset distance; and wherein the offset distance is about one-tenth of a total width of the offset shingle.

8. An offset shingle comprising:

a headlap portion extending from a top edge to a tab portion, the tab portion extending from the headlap portion to a bottom edge, the headlap portion and the tab portion extending between first and second side edges; and three transverse cuts extending from the bottom edge to the headlap portion; and frangible lines of weakness in line with the transverse cuts, the lines of weakness extending from the transverse cuts to the top edge;

wherein the cuts and lines of weakness separate the shingle into first, second, third, and fourth offset portions having first, second, third, and fourth widths;

wherein the first width is equal to an offset distance;

wherein the second width is greater than the first width by at least the offset distance;

wherein the third width is greater than the second width by at least the offset distance; and wherein the fourth width is greater than the third width by at least the offset distance and the fourth width is equal to one-half of a total width of the offset shingle between the first and second side edges.

* * * * *